US010818301B2

(12) United States Patent
Kastner et al.

(10) Patent No.: US 10,818,301 B2
(45) Date of Patent: Oct. 27, 2020

(54) ENCODER, DECODER, SYSTEM AND METHOD EMPLOYING A RESIDUAL CONCEPT FOR PARAMETRIC AUDIO OBJECT CODING

(71) Applicant: Fraunhofer-Gesellschaft zur Foerderung der angewandten Forschung e.V., Munich (DE)

(72) Inventors: Thorsten Kastner, Erlangen (DE); Juergen Herre, Buckenhof (DE); Jouni Paulus, Erlangen (DE); Leon Terentiv, Erlangen (DE); Oliver Hellmuth, Erlangen (DE); Harald Fuchs, Roettenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/617,706

(22) Filed: Feb. 9, 2015

(65) Prior Publication Data

US 2015/0162012 A1 Jun. 11, 2015

Related U.S. Application Data

(63) Continuation of application No. PCT/EP2013/057932, filed on Apr. 16, 2013.
(Continued)

(51) Int. Cl.
*G10L 19/008* (2013.01)

(52) U.S. Cl.
CPC ..... *G10L 19/008* (2013.01)

(58) Field of Classification Search
USPC ..... 704/500–504
See application file for complete search history.

(56) References Cited

U.S. PATENT DOCUMENTS 7,573,912 B2 8/2009 Lindblom
7,751,572 B2 7/2010 Villemoes et al.
(Continued)

FOREIGN PATENT DOCUMENTS

AU 2013301831 B2 12/2016
CN 101006494 A 7/2007
(Continued)

OTHER PUBLICATIONS

Engdegard, J. et al, "Spatial Audio Object Coding (SAOC)—The Upcoming MPEG Standard on Parametric Object Based Audio Coding", 124th AES Convention, Audio Engineering Society, Paper 7377, May 17, 2008, pp. 1-15.
(Continued)

*Primary Examiner* — Leonard Saint Cyr
(74) *Attorney, Agent, or Firm* — Michael A. Glenn; Perkins Coie LLP

(57) ABSTRACT

A decoder is provided. The decoder includes a parametric decoding unit for generating a plurality of first estimated audio object signals by upmixing three or more downmix signals, wherein the three or more downmix signals encode a plurality of original audio object signals, wherein the parametric decoding unit is configured to upmix the three or more downmix signals depending on parametric side information indicating information on the plurality of original audio object signals. Moreover, the decoder includes a residual processing unit for generating a plurality of second estimated audio object signals by modifying one or more of the first estimated audio object signals, wherein the residual processing unit is configured to modify the one or more of the first estimated audio object signals depending on one or more residual signals.

25 Claims, 18 Drawing Sheets

Related U.S. Application Data

(60) Provisional application No. 61/681,730, filed on Aug. 10, 2012.

(56) References Cited

U.S. PATENT DOCUMENTS

| | | | | |
|---|---|---|---|---|
| 7,945,449 | B2 | 5/2011 | Vinton et al. | |
| 8,958,566 | B2 | 2/2015 | Hellmuth et al. | |
| 2009/0125314 | A1* | 5/2009 | Hellmuth | G10L 19/008 704/501 |
| 2010/0228554 | A1 | 9/2010 | Beack et al. | |
| 2011/0040556 | A1* | 2/2011 | Moon | G10L 19/008 704/205 |
| 2011/0040566 | A1 | 2/2011 | Moon et al. | |
| 2011/0046964 | A1* | 2/2011 | Moon | G10L 19/008 704/500 |
| 2011/0103592 | A1* | 5/2011 | Kim | G10L 19/008 381/22 |
| 2011/0255588 | A1* | 10/2011 | Shim | G10L 19/008 375/240 |
| 2012/0177204 | A1* | 7/2012 | Hellmuth | G10L 19/008 381/22 |
| 2012/0224702 | A1* | 9/2012 | Den Brinker | G10L 19/008 381/22 |
| 2012/0259643 | A1* | 10/2012 | Engdegard | G10L 19/008 704/500 |
| 2015/0162012 | A1 | 6/2015 | Hellmuth et al. | |

FOREIGN PATENT DOCUMENTS

| | | | |
|---|---|---|---|
| CN | 101120615 | A | 2/2008 |
| CN | 101160619 | A | 4/2008 |
| CN | 102460573 | A | 5/2012 |
| EP | 2077550 | A1 | 7/2009 |
| EP | 2883225 | B1 | 6/2017 |
| JP | 2011501230 | A | 1/2011 |
| KR | 10-2008-0029940 | A | 4/2008 |
| KR | 1020080029940 | A | 4/2008 |
| RU | 2010154749 | A | 7/2012 |
| WO | 2010042024 | A1 | 4/2010 |
| WO | 2010149700 | A1 | 12/2010 |
| WO | 2011124616 | A1 | 10/2011 |
| WO | 2012045816 | A1 | 4/2012 |
| WO | 2012058805 | A1 | 5/2012 |
| WO | 2012075246 | A2 | 6/2012 |
| WO | 2014023443 | A1 | 2/2014 |

OTHER PUBLICATIONS

Falch, Cornelia et al., "Spatial Audio Object Coding With Enhanced Audio Object Separation", Fraunhofer Institute for Integrated Circuits, Erlangen, Germany Proc. of the 13th Int. Conference on Digital Audio Effects (DAFx-10), Graz, Austria, Sep. 6-10, 2010.

Faller et al., "Binaural Cue Coding—Part II: Schemes and Applications", IEEE Transactions on Speech and Audio Processing, vol. 11, No. 6, Nov. 2003, pp. 520-531.

Faller, C. , "Parametric Joint-Coding of Audio Sources", AES Convention Paper 6752, Presented at the 120th Convention, Paris, France, May 20-23, 2006, 12 pages.

Girin, L et al., "Informed audio source separation from compressed linear stereo mixtures", AES 42nd International Conference: Semantic Audio, <hal-00695724>, Jul. 2011, pp. 159-168.

Herre, et al., "From SAC to SAOC—Recent Developments in Parametric Coding of Spatial Audio", Illusions in Sound, AES 22nd UK Conference, Apr. 2007, 8 pages.

ISO/IEC, "MPEG audio technologies—Part 2: Spatial Audio Object Coding (SAOC)", ISO/IEC JTC1/SC29/WG11 (MPEG) International Standard 23003-2., Oct. 1, 2010, pp. 1-130.

Kim et al., "Spatial Audio Object Coding With Two-Step Coding Structure for Interactive Audio Service", IEEE Transactions on Multimedia, vol. 13, No. 6, Dec. 2011, 9 pages.

Liutkus, A et al., "Informed source separation through spectrogram coding and data embedding", 2011 IEEE Workshop on Applications of Signal Processing to Audio and Acoustics, Oct. 16-19, 2011, 4 pages.

Ozerov, et al., "Informed source separation: source coding meets source separation", IEEE Workshop on Applications of Signal Processing to Audio and Acoustics; Mohonk, NY, Oct. 2011, 5 pages.

Parvaix et al., "Informed Source Separation of underdetermined instantaneous Stereo Mixtures using Source Index Embedding", IEEE ICASSP, Mar. 2010, pp. 245-248.

Parvaix, M et al., "A Watermarking-Based Method for Informed Source Separation of Audio Signals With a Single Sensor", IEEE Transactions on Audio, Speech and Language Processing, vol. 18, No. 6, Aug. 2010, pp. 1464-1475.

Zhang, S. et al., "An Informed Audio Source Separation System for Speech Signals", INTERSPEECH Aug. 2011, 5 pages.

* cited by examiner

ENCODER, DECODER, SYSTEM AND METHOD EMPLOYING A RESIDUAL CONCEPT FOR PARAMETRIC AUDIO OBJECT CODING

CROSS-REFERENCE TO RELATED APPLICATIONS

This application is a continuation of copending International Application No. PCT/EP2013/057932, filed Apr. 16, 2013, which claims priority from U.S. Provisional Application No. 61/681,730, filed Aug. 10, 2012, each of which is incorporated herein in its entirety by this reference thereto.

BACKGROUND OF THE INVENTION

The present invention relates to audio signal encoding, decoding and processing, and, in particular, to an encoder, a decoder and a method, which employ residual concepts for parametric audio object coding.

Recently, parametric techniques for the bitrate-efficient transmission/storage of audio scenes comprising multiple audio objects have been proposed in the field of audio coding (see, e.g., [BCC], [JSC], [SAOC], [SAOC1] and [SAOC2]) and informed source separation (see, e.g., [ISS1], [ISS2], [ISS3], [ISS4], [ISS5] and [ISS6]). These techniques aim at reconstructing a desired output audio scene or a desired audio source object on the basis of additional side information describing the transmitted and/or stored audio scene and/or the audio source objects in the audio scene.

FIG. 5 depicts a SAOC (SAOC=Spatial Audio Object Coding) system overview illustrating the principle of such parametric systems using the example of MPEG SAOC (MPEG=Moving Picture Experts Group) (see, e.g., [SAOC], [SAOC1] and [SAOC2]).

The general processing is carried out in a time/frequency selective way and can be described as follows:

The SAOC encoder 510, in particular, a side information estimator 530 of the SAOC encoder 510, extracts the side information describing the characteristics of the maximum 32 input audio object signals $s_1 \ldots s_{32}$ (in its simplest form the relations of the object powers of the audio object signals). A mixer 520 of the SAOC encoder 510 downmixes the audio object signals $s_1 \ldots s_{32}$ to obtain a mono or 2-channel signal mixture (i.e., one or two downmix signals) using the downmix gain factors $d_{1,1} \ldots d_{32,2}$.

The downmix signal(s) and side information are transmitted or stored. To this end, the downmix audio signal(s) may be encoded using an audio encoder 540. The audio encoder 540 may be a well-known perceptual audio encoder, for example, an MPEG-1 Layer II or III (aka .mp3) audio encoder, an MPEG Advanced Audio Coding (AAC) audio encoder, etc.

On a receiver side, a corresponding audio decoder 550, e.g., a perceptual audio decoder, such as an MPEG-1 Layer II or III (aka .mp3) audio decoder, an MPEG Advanced Audio Coding (AAC) audio decoder, etc. decodes the encoded downmix audio signal(s).

An SAOC decoder 560 conceptually attempts to restore the original (audio) object signals ("object separation") from the one or two downmix signals using the transmitted and/or stored side information, e.g., by employing a virtual object separator 570. These approximated (audio) object signals $s_{1,est} \ldots s_{32,est}$ are then mixed by a renderer 580 of the SAOC decoder 560 into a target scene represented by a maximum of 6 audio output channels $y_{1,est} \ldots y_{6,est}$ using a rendering matrix (described by the coefficients $r_{1,1} \ldots r_{32,6}$). The output can be a single-channel, a 2-channel stereo or a 5.1 multi-channel target scene (e.g., one, two or six audio output signals).

Due to the underlying limitations of the parametric estimation of the audio objects at the decoding side; in most cases, the desired target output scene cannot be perfectly generated. At extreme operating points (for example, solo playback of one audio object), often, the processing can no longer achieve an adequate subjective sound. To this end, the SAOC scheme has been extended by introducing Enhanced Audio Objects (EAOs) (see, e.g., [Dfx], see, e.g., moreover, [SAOC]). Audio objects that are encoded as EAOs exhibit an increased separation capability from the other (regular) non-Enhanced Audio Objects (non-EAOs) encoded in the same downmix signal at the expense of an increased side information rate. The EAO concept considers for each EAO the prediction error (residual signal) of the parametric model.

FIG. 6 depicts residual estimation at the encoder side, schematically illustrating the computation of the residual signals for each EAO. In the SAOC encoder, residual signals (up to 4 EAOs) are estimated using the extracted Parametric Side Information (PSI) and the original source signals, waveform coded and included into the SAOC bitstream as non-parametric Residual Side Information (RSI). In more detail, a PSI SAOC Decoder for EAOs 610 generates estimated audio object signals $s_{est,EAO}$ from a downmix X. An RSI Generation Unit 620 then generates up to four residual signals $s_{res,RSI\ \{1,\ldots,4\}}$ based on the generated estimated audio object signals $s_{est,EAO}$ and based on the original EAO audio object signals $s_1, \ldots, s_4$.

FIG. 7 depicts a basic structure of the SAOC decoder with EAO support, illustrating a conceptual overview of the EAO processing scheme integrated into the SAOC decoding/transcoding chain (transcoding=data conversion from one encoding to another encoding).

Downmix signal oriented parameters, namely, Channel Prediction Coefficients (CPCs) are derived from the Parametric Side Info (PSI) by a CPC Estimation unit 710.

The CPCs together with the downmix signal are fed into a Two-to-N-box (TTN-box) 720. The TTN-box 720 conceptually tries to estimate the EAOs ($s_{est,EAO}$) from the transmitted downmix signal (X) and to provide an estimated non-EAO downmix ($X_{est,nonEAO}$) consisting of only non-EAOs.

The transmitted/stored (and decoded) residual signals ($s_{res,\ RSI}$) are used by a RSI processing unit 730 to enhance the estimates of the EAOs ($s_{est,\ EAO}$) and the corresponding downmix of only non-EAO objects ($X_{nonEAO}$).

According to the state of the art, in the next step, the RSI processing unit 730 feeds the non-EAO downmix signal ($X_{nonEAO}$) into a SAOC downmix processor (a PSI decoding unit) 740 to estimate the non-EAO objects $s_{est,nonEAO}$. The PSI decoding unit 740 passes the estimated non-EAO audio objects $s_{est,nonEAO}$ to the rendering unit 750. Moreover, the RSI processing unit directly feeds the enhanced EAOs $\hat{s}_{est,EAO}$ into the rendering unit 750. The rendering unit 750 then generates mono or stereo output signals based on the estimated non-EAO audio objects $s_{est,nonEAO}$ and based on the enhanced EAOs $\hat{s}_{est,EAO}$.

The state of the art system has the following drawbacks:

Before the residual signals are applied to calculate EAOs in the SAOC decoder, downmix-oriented CPCs have to be computed from the transmitted/stored parametric side information.

All downmix signals have to be processed within the SAOC residual concept regardless of their usefulness for the EAO processing.

The SAOC residual concept can only be used with single- or two-channel signal mixtures due to the limitations of the TTN-box. The EAO residual concept cannot be used in combination with multi-channel mixtures (e.g., 5.1 multi-channel mixtures).

Furthermore, due to the corresponding computational complexity of their estimation, the SAOC EAO processing sets limitations on the number of EAOs (i.e., up to 4).

Because of these limitations, the SAOC EAO residual handling concept cannot be applied to multi-channel (e.g., 5.1) downmix signals or used for more than 4 EAOs.

SUMMARY

According to an embodiment, a decoder may have: a parametric decoding unit for generating a plurality of first estimated audio object signals by upmixing three or more downmix signals, wherein the three or more downmix signals encode a plurality of original audio object signals, wherein the parametric decoding unit is configured to upmix the three or more downmix signals depending on parametric side information indicating information on the plurality of original audio object signals, and a residual processing unit for generating a plurality of second estimated audio object signals by modifying one or more of the first estimated audio object signals, wherein the residual processing unit is configured to modify said one or more of the first estimated audio object signals depending on one or more residual signals.

According to another embodiment, a residual signal generator may have: a parametric decoding unit for generating a plurality of estimated audio object signals by upmixing three or more downmix signals, wherein the three or more downmix signals encode a plurality of original audio object signals, wherein the parametric decoding unit is configured to upmix the three or more downmix signals depending on parametric side information indicating information on the plurality of original audio object signals, and a residual estimation unit for generating a plurality of residual signals based on the plurality of original audio object signals and based on the plurality of estimated audio object signals, such that each of the plurality of residual signals is a difference signal indicating a difference between one of the plurality of original audio object signals and one of the plurality of estimated audio object signals.

According to another embodiment, an encoder for encoding a plurality of original audio object signals by generating three or more downmix signals, by generating parametric side information and by generating a plurality of residual signals, may have: a downmix generator for providing the three or more downmix signals indicating a downmix of the plurality of original audio object signals, a parametric side information estimator for generating the parametric side information indicating information on the plurality of original audio object signals, to obtain the parametric side information, and an inventive residual signal generator, wherein the parametric decoding unit of the residual signal generator is adapted to generate a plurality of estimated audio object signals by upmixing the three or more downmix signals provided by the downmix generator, wherein the downmix signals encode the plurality of original audio object signals, wherein the parametric decoding unit is configured to upmix the three or more downmix signals depending on the parametric side information generated by the parametric side information estimator, and wherein the residual estimation unit of the residual signal generator is adapted to generate the plurality of residual signals based on the plurality of original audio object signals and based on the plurality of estimated audio object signals, such that each of the plurality of residual signals indicates a difference between one of the plurality of original audio object signals and one of the plurality of estimated audio object signals.

According to another embodiment, a system may have: an inventive encoder for encoding a plurality of original audio object signals by generating three or more downmix signals, by generating parametric side information and by generating a plurality of residual signals, and an inventive decoder, wherein the decoder is configured to generate a plurality of second estimated audio object signals based on the three or more downmix signals being generated by the encoder, based on the parametric side information being generated by the encoder and based on the plurality of residual signals being generated by the encoder.

Another embodiment may have an encoded audio signal, having three or more downmix signals, parametric side information and a plurality of residual signals, wherein the three or more downmix signals are a downmix of a plurality of original audio object signals, wherein the parametric side information includes parameters indicating side information on the plurality of original audio object signals, wherein each of the plurality of residual signals is a difference signal indicating a difference between one of the plurality of original audio signals and one of a plurality of estimated audio object signals.

According to another embodiment, a method may have the steps of: generating a plurality of first estimated audio object signals by upmixing three or more downmix signals, wherein the three or more downmix signals encode a plurality of original audio object signals, wherein generating the plurality of first estimated audio object signals includes upmixing the three or more downmix signals depending on parametric side information indicating information on the plurality of original audio object signals, and generating a plurality of second estimated audio object signals by modifying one or more of the first estimated audio object signals, wherein generating a plurality of second estimated audio object signals includes modifying said one or more of the first estimated audio object signals depending on one or more residual signals.

According to another embodiment, a method may have the steps of: generating a plurality of estimated audio object signals by upmixing three or more downmix signals, wherein the three or more downmix signals encode a plurality of original audio object signals, wherein generating the plurality of estimated audio object signals includes upmixing the three or more downmix signals depending on parametric side information indicating information on the plurality of original audio object signals, and generating a plurality of residual signals based on the plurality of original audio object signals and based on the plurality of estimated audio object signals, such that each of the plurality of residual signals is a difference signal indicating a difference between one of the plurality of original audio object signals and one of the plurality of estimated audio object signals.

Another embodiment may have a computer program for implementing the inventive methods when being executed on a computer or signal processor.

A decoder is provided. The decoder comprises a parametric decoding unit for generating a plurality of first estimated audio object signals by upmixing three or more downmix signals, wherein the three or more downmix signals encode a plurality of original audio object signals, wherein the parametric decoding unit is configured to upmix the three or more downmix signals depending on parametric side information indicating information on the plurality of original audio object signals. Moreover, the decoder comprises a residual processing unit for generating a plurality of second estimated audio object signals by modifying one or more of the first estimated audio object signals, wherein the residual processing unit is configured to modify said one or more of the first estimated audio object signals depending on one or more residual signals.

Embodiment present an object oriented residual concept which improves the perceived quality of the EAOs. Unlike the state of the art system, the presented concept is neither restricted to the number of downmix signals nor to the number of EAOs. Two methods for deriving object related residual signals are presented. A cascaded concept with which the energy of the residual signal is iteratively reduced with increasing number of EAOs at the cost of higher computational complexity, and a second concept with less computational complexity in which all residuals are estimated simultaneously.

Furthermore, embodiments provide an improved concept of applying object oriented residual signals at the decoder side, and concepts with reduced complexity designed for application scenarios in which only the EAOs are manipulated at the decoder side, or the modification of the non-EAOs is restricted to a gain scaling.

According to an embodiment, the residual processing unit may be configured to modify the said one or more of the first estimated audio object signals depending on at least three residual signals. The decoder is adapted to generate at least three audio output channels based on the plurality of second estimated audio object signals.

According to an embodiment, the decoder further may comprise a downmix modification unit. The residual processing unit may determine one or more audio object signals of the plurality of second estimated audio object signals. The downmix modification unit may be adapted to remove the determined one or more second estimated audio object signals from the three or more downmix signals to obtain three or more modified downmix signals. The parametric decoding unit may be configured to determine one or more audio object signals of the first estimated audio object signals based on the three or more modified downmix signals.

In a particular embodiment, the downmix modification unit may, for example, be adapted to apply the formula $$\tilde{X}_{nonEAO}=X-DZ^{*}_{eao}S_{eao}.$$

Moreover, the decoder may be adapted to conduct two or more iteration steps. For each iteration step, the parametric decoding unit may be adapted to determine exactly one audio object signal of the plurality of first estimated audio object signals. Moreover, for said iteration step, the residual processing unit may be adapted to determine exactly one audio object signal of the plurality of second estimated audio object signals by modifying said audio object signal of the plurality of first estimated audio object signals. Furthermore, for said iteration step, the downmix modification unit may be adapted to remove said audio object signal of the plurality of second estimated audio object signals from the three or more downmix signals to modify the three or more downmix signals. In the next iteration step following said iteration step, the parametric decoding unit may be adapted to determine exactly one audio object signal of the plurality of first estimated audio object signals based on the three or more downmix signals which have been modified.

In an embodiment, each of the one or more residual signals may indicate a difference between one of the plurality of original audio object signals and one of the one or more first estimated audio object signals.

According to an embodiment, wherein the residual processing unit may be adapted to generate the plurality of second estimated audio object signals by modifying five or more of the first estimated audio object signals, wherein the residual processing unit may be configured to modify said five or more of the first estimated audio object signals depending on five or more residual signals.

In another embodiment, the decoder may be configured to generate seven or more audio output channels based on the plurality of second estimated audio object signals.

According to a further embodiment, the decoder may be adapted to not determine Channel Prediction Coefficients to determine the plurality of second estimated audio object signals. Embodiments provide concepts so that the calculation of the Channel Prediction Coefficients that have so far been necessitated for decoding in state-of-the-art SAOC, is no longer necessitated for decoding.

In a further embodiment, the decoder may be an SAOC decoder.

Moreover, a residual signal generator is provided. The residual signal generator comprises a parametric decoding unit for generating a plurality of estimated audio object signals by upmixing three or more downmix signals, wherein the three or more downmix signals encode a plurality of original audio object signals, wherein the parametric decoding unit is configured to upmix the three or more downmix signals depending on parametric side information indicating information on the plurality of original audio object signals. Moreover, the residual signal generator comprises a residual estimation unit for generating a plurality of residual signals based on the plurality of original audio object signals and based on the plurality of estimated audio object signals, such that each of the plurality of residual signals is a difference signal indicating a difference between one of the plurality of original audio object signals and one of the plurality of estimated audio object signals.

In an embodiment, the residual estimation unit may be adapted to generate at least five residual signals based on at least five original audio object signals of the plurality of original audio object signals and based on at least five estimated audio object signals of the plurality of estimated audio object signals.

In an embodiment, the residual signal generator may further comprise a downmix modification unit being adapted to modify the three or more downmix signals to obtain three or more modified downmix signals. The parametric decoding unit may be configured to determine one or more audio object signals of the first estimated audio object signals based on the three or more modified downmix signals.

In an embodiment, the downmix modification unit may, for example, be configured to modify the three or more original downmix signals to obtain the three or more modified downmix signals, by removing one or more of the plurality of original audio object signals from the three or more original downmix signals.

In another embodiment, the downmix modification unit may, for example, be configured to modify the three or more original downmix signals to obtain the three or more modified downmix signals by generating one or more modified audio object signals based on one or more of the estimated audio object signals and based on one or more of the residual signals, and by removing the one or more modified audio object signals from the three or more original downmix signals. E.g. each of the one or more modified audio object signals may be generated by the downmix modification unit by modifying one of the estimated audio object signals, wherein the downmix modification unit may be adapted to modify said estimated audio object signal depending on one of the one or more residual signals.

In both of the embodiments described above, the downmix modification unit may, for example, be adapted to apply the formula $\tilde{X}=X-DZ_{eao}*S_{eao}$, wherein X is the downmix to be modified, wherein D indicates downmixing information, wherein $S_{eao}$ comprises the original audio object signals to be removed or the modified audio object signals, wherein $Z_{eao}*$ indicates the locations of the signals to be removed, and wherein X is the modified downmix signal. E.g., a location (position) of an audio object signal corresponds to the location (position) of its audio object in the list of all objects.

According to an embodiment, the residual signal generator may be adapted to conduct two or more iteration steps. For each iteration step, the parametric decoding unit may be adapted to determine exactly one audio object signal of the plurality of estimated audio object signals. Moreover, for said iteration step, the residual estimation unit may be adapted to determine exactly one residual signal of the plurality of residual signals by modifying said audio object signal of the plurality of estimated audio object signals. Furthermore, for said iteration step, the downmix modification unit may be adapted to modify the three or more downmix signals. In the next iteration step following said iteration step, the parametric decoding unit may be adapted to determine exactly one audio object signal of the plurality of estimated audio object signals based on the three or more downmix signals which have been modified.

In an embodiment, an encoder for encoding a plurality of original audio object signals by generating three or more downmix signals, by generating parametric side information and by generating a plurality of residual signals is provided. The encoder comprises a downmix generator for providing the three or more downmix signals indicating a downmix of the plurality of original audio object signals. Moreover, the encoder comprises a parametric side information estimator for generating the parametric side information indicating information on the plurality of original audio object signals, to obtain the parametric side information. Furthermore, the encoder comprises a residual signal generator according to one of the above-described embodiments. The parametric decoding unit of the residual signal generator is adapted to generate a plurality of estimated audio object signals by upmixing the three or more downmix signals provided by the downmix generator, wherein the downmix signals encode the plurality of original audio object signals. The parametric decoding unit is configured to upmix the three or more downmix signals depending on the parametric side information generated by the parametric side information estimator. The residual estimation unit of the residual signal generator is adapted to generate the plurality of residual signals based on the plurality of original audio object signals and based on the plurality of estimated audio object signals, such that each of the plurality of residual signals indicates a difference between one of the plurality of original audio object signals and one of the plurality of estimated audio object signals.

In an embodiment, the encoder may be an SAOC encoder.

Moreover, a system is provided. The system comprises an encoder according to one of the above-described embodiments for encoding a plurality of original audio object signals by generating three or more downmix signals, by generating parametric side information and by generating a plurality of residual signals. Furthermore, the system comprises a decoder according to one of the above-described embodiments, wherein the decoder is configured to generate a plurality of audio output channels based on the three or more downmix signals being generated by the encoder, based on the parametric side information being generated by the encoder and based on the plurality of residual signals being generated by the encoder.

Furthermore, an encoded audio signal is provided. The encoded audio signal comprises three or more downmix signals, parametric side information and a plurality of residual signals. The three or more downmix signals are a downmix of a plurality of original audio object signals. The parametric side information comprises parameters indicating side information on the plurality of original audio object signals. Each of the plurality of residual signals is a difference signal indicating a difference between one of the plurality of original audio signals and one of a plurality of estimated audio object signals.

Moreover, a method is provided. The method comprises;

Generating a plurality of first estimated audio object signals by upmixing three or more downmix signals, wherein the three or more downmix signals encode a plurality of original audio object signals, wherein generating the plurality of first estimated audio object signals comprises upmixing the three or more downmix signals depending on parametric side information indicating information on the plurality of original audio object signals. And:

Generating a plurality of second estimated audio object signals by modifying one or more of the first estimated audio object signals, wherein generating a plurality of second estimated audio object signals comprises modifying said one or more of the first estimated audio object signals depending on one or more residual signals.

Furthermore, another method is provided. Said method comprises:

Generating a plurality of estimated audio object signals by upmixing three or more downmix signals, wherein the three or more downmix signals encode a plurality of original audio object signals, wherein generating the plurality of estimated audio object signals comprises upmixing the three or more downmix signals depending on parametric side information indicating information on the plurality of original audio object signals. And:

Generating a plurality of residual signals based on the plurality of original audio object signals and based on the plurality of estimated audio object signals, such that each of the plurality of residual signals is a difference signal indicating a difference between one of the plurality of original audio object signals and one of the plurality of estimated audio object signals.

Moreover, a computer program for implementing one of the above-described methods when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Figure 2A:
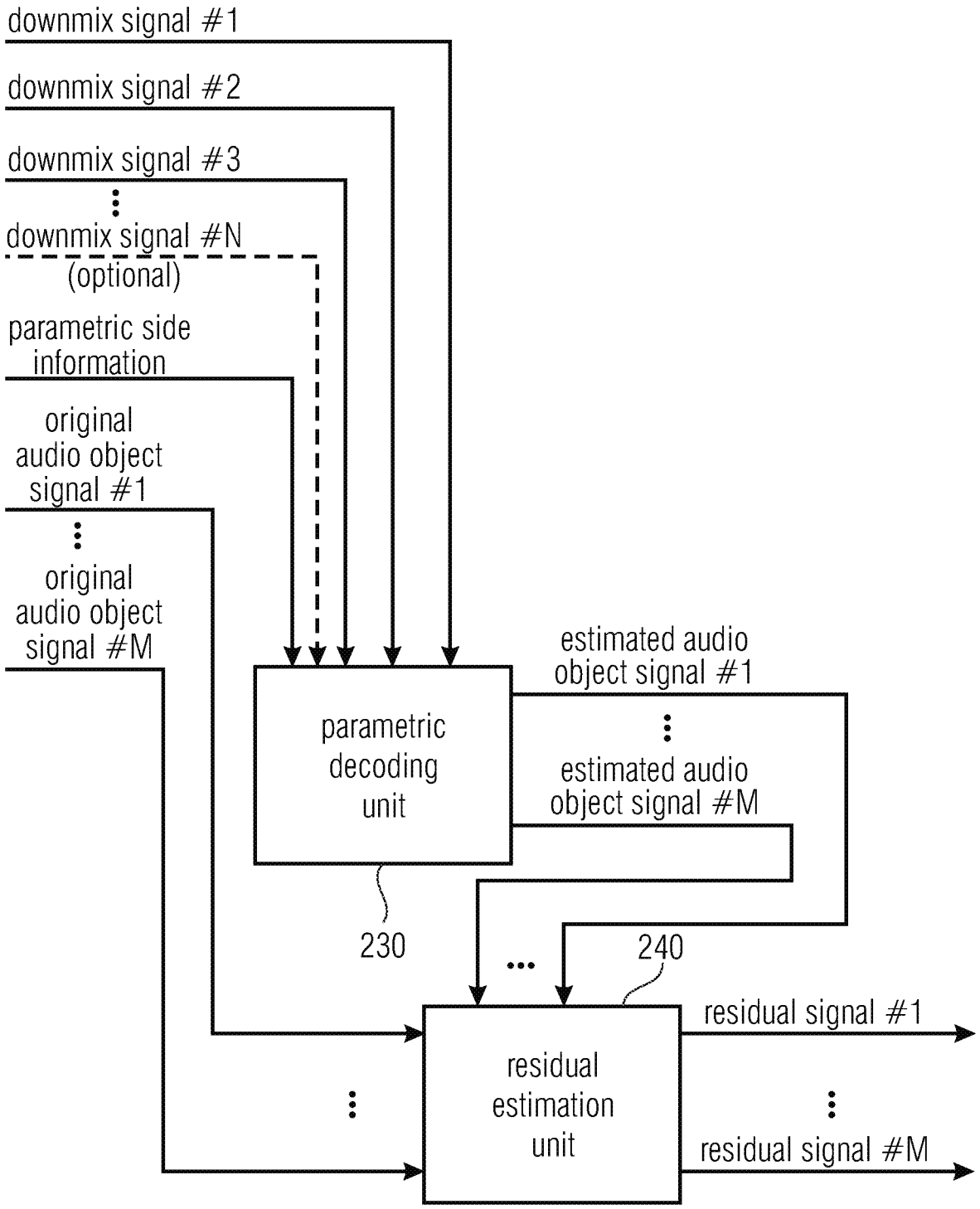
FIG. 2*a* illustrates a residual signal generator according to an embodiment.

FIG. 2*a* illustrates a residual signal generator 200 according to an embodiment.

The residual signal generator 200 comprises a parametric decoding unit 230 for generating a plurality of estimated audio object signals (Estimated Audio Object Signal #1, . . . Estimated Audio Object Signal #M) by upmixing three or more downmix signals (Downmix Signal #1, Downmix Signal #2, Downmix Signal #3, . . . , Downmix Signal #N). The three or more downmix signals (Downmix Signal #1, Downmix Signal #2, Downmix Signal #3, . . . , Downmix Signal #N) encode a plurality of original audio object signals (Original Audio Object Signal #1, . . . , Original Audio Object Signal #M). The parametric decoding unit 230 is configured to upmix the three or more downmix signals (Downmix Signal #1, Downmix Signal #2, Downmix Signal #3, . . . , Downmix Signal #N) depending on parametric side information indicating information on the plurality of original audio object signals (Original Audio Object Signal #1, . . . , Original Audio Object Signal #M). Moreover, the residual signal generator 200 comprises a residual estimation unit 240 for generating a plurality of residual signals (Residual Signal #1, . . . , Residual Signal #M) based on the plurality of original audio object signals (Original Audio Object Signal #1, . . . , Original Audio Object Signal #M) and based on the plurality of estimated audio object signals (Estimated Audio Object Signal #1, . . . Estimated Audio Object Signal #M), such that each of the plurality of residual signals (Residual Signal #1, . . . , Residual Signal #M) is a difference signal indicating a difference between one of the plurality of original audio object signals (Original Audio Object Signal #1, . . . , Original Audio Object Signal #M) and one of the plurality of estimated audio object signals (Estimated Audio Object Signal #1, . . . Estimated Audio Object Signal #M).

The encoder according to the above-described embodiment overcomes the SAOC restrictions (see [SAOC]) of the state of the art.

Present SAOC systems conduct downmixing by employing one or more two-to-one-boxes or one or more three-to-to boxes. Inter alia, because of these underlying restrictions, present SAOC systems can downmix audio object signals to at most two downmix channels/two downmix signals.

Concepts for residual signal generators and for encoders are provided, which allow to overcome the restrictions of SAOC so that Audio Object Coding is now advantageous for transmission systems which employ more than two transmission channels.

In an embodiment, the residual estimation unit 240 is adapted to generate at least five residual signals based on at least five original audio object signals of the plurality of original audio object signals and based on at least five estimated audio object signals of the plurality of estimated audio object signals.

Figure 2B:
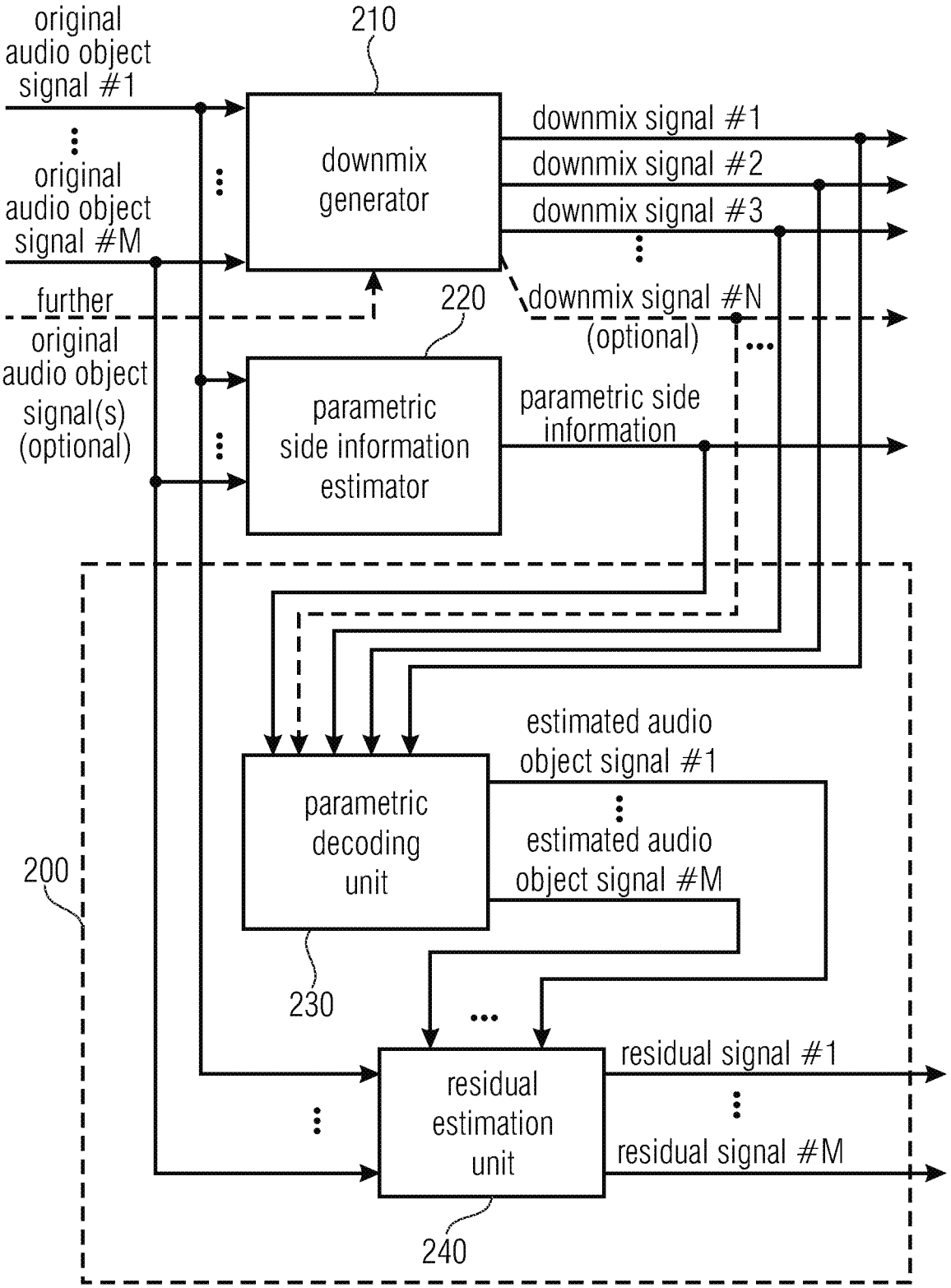
FIG. 2*b* illustrates an encoder according to an embodiment.

FIG. 2*b* illustrates an encoder according to an embodiment. The encoder of FIG. 2*b* comprises a residual signal generator 200.

Moreover, the encoder comprises a downmix generator 210 for providing the three or more downmix signals (Downmix Signal #1, Downmix Signal #2, Downmix Signal #3, . . . , Downmix Signal #N) indicating a downmix of the plurality of original audio object signals (Original Audio Object Signal #1, . . . , Original Audio Object Signal #M, further Original Audio Object Signal(s)).

Regarding the Original Audio Object Signal #1, . . . , Original Audio Object Signal #M, the residual estimation unit 240 generates a residual signal (Residual Signal #1, . . . , Residual Signal #M). Thus, Original Audio Object Signal #1, . . . , Original Audio Object Signal #M refer to Enhanced Audio Objects (EAOs).

However, as can be seen in FIG. 2*b*, further original audio object signal(s) may optionally exist, which are downmixed, but for which no residual signals will be generated. These further original audio object signal(s) refer thus to Non-Enhanced Audio Objects (Non-EAOs).

The encoder of FIG. 2*b* further comprises a parametric side information estimator 220 for generating the parametric side information indicating information on the plurality of original audio object signals (Original Audio Object Signal #1, . . . , Original Audio Object Signal #M, further Original Audio Object Signal(s)), to obtain the parametric side information. In the embodiment of FIG. 2*b*, the parametric side information estimator also takes original audio object signals (further Original Audio Object Signal(s)) referring to non-EAOs into account.

In an embodiment, the number of original audio object signals may be equal to the number of residual signals, e.g., when all original audio object signals refer to EAOs.

In other embodiments, however, the number of residual signals may differ from the number of original audio object signals and/or may differ from the number of estimated audio object signals, e.g., when original audio objects signals refer to Non-EAOs.

In some embodiments, the encoder is a SAOC encoder.

Figure 1A:
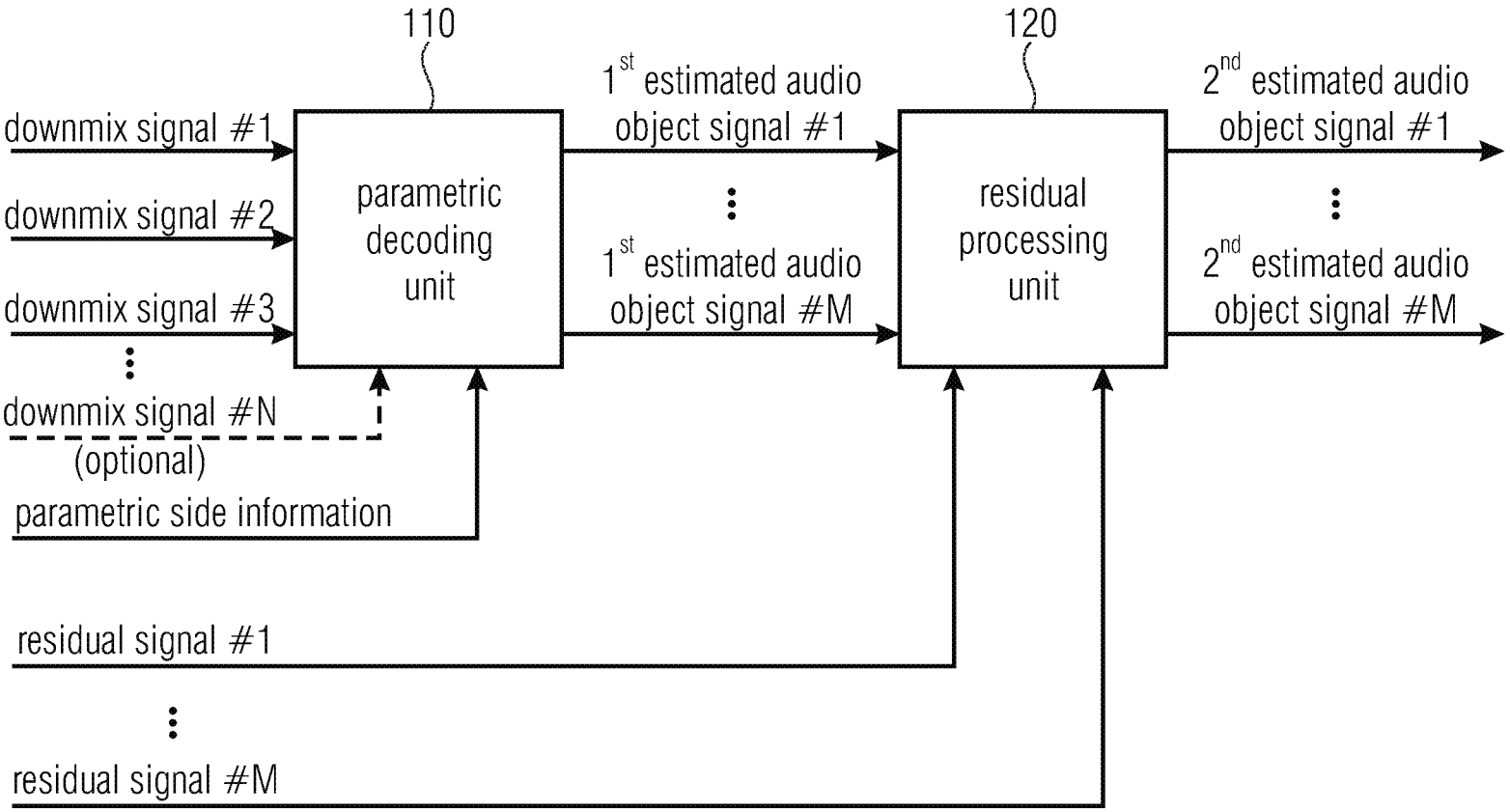
FIG. 1*a* illustrates a decoder according to an embodiment.

FIG. 1*a* illustrates a decoder according to an embodiment.

The decoder comprises a parametric decoding unit 110 for generating a plurality of first estimated audio object signals ($1^{st}$ Estimated Audio Object Signal #1, . . . $1^{st}$ Estimated Audio Object Signal #M) by upmixing three or more downmix signals (Downmix Signal #1, Downmix Signal #2, Downmix Signal #3, . . . , Downmix Signal #N), wherein the three or more downmix signals (Downmix Signal #1, Downmix Signal #2, Downmix Signal #3, . . . , Downmix Signal #N) encode a plurality of original audio object signals, wherein the parametric decoding unit 110 is configured to upmix the three or more downmix signals (Downmix Signal #1, Downmix Signal #2, Downmix Signal #3, . . . , Downmix Signal #N) depending on parametric side information indicating information on the plurality of original audio object signals.

Moreover, the decoder comprises a residual processing unit 120 for generating a plurality of second estimated audio object signals ($2^{nd}$ Estimated Audio Object Signal #1, . . . $2^{nd}$ Estimated Audio Object Signal #M) by modifying one or more of the first estimated audio object signals ($1^{st}$ Estimated Audio Object Signal #1, . . . $1^{st}$ Estimated Audio Object Signal #M), wherein the residual processing unit 120 is configured to modify said one or more of the first estimated audio object signals ($1^{st}$ Estimated Audio Object Signal #1, . . . $1^{st}$ Estimated Audio Object Signal #M) depending on one or more residual signals (Residual Signal #1, . . . , Residual Signal #M).

The decoder according to the above-described embodiment overcomes the SAOC restrictions (see [SAOC]) of the state of the art.

Furthermore, present SAOC systems conduct upmixing by employing one or more one-to-two-boxes (OTT boxes) or one or more two-to-three-boxes (TTT boxes). Inter alia, because of these restrictions, audio object signals encoded with more than two downmix signals/downmix channels cannot be upmixed by state-of-the-art SAOC decoders.

Concepts for decoders are provided, which allow to overcome the restrictions of SAOC so that Audio Object Coding is now advantageous for transmission systems which employ more than two transmission channels.

Figure 1B:
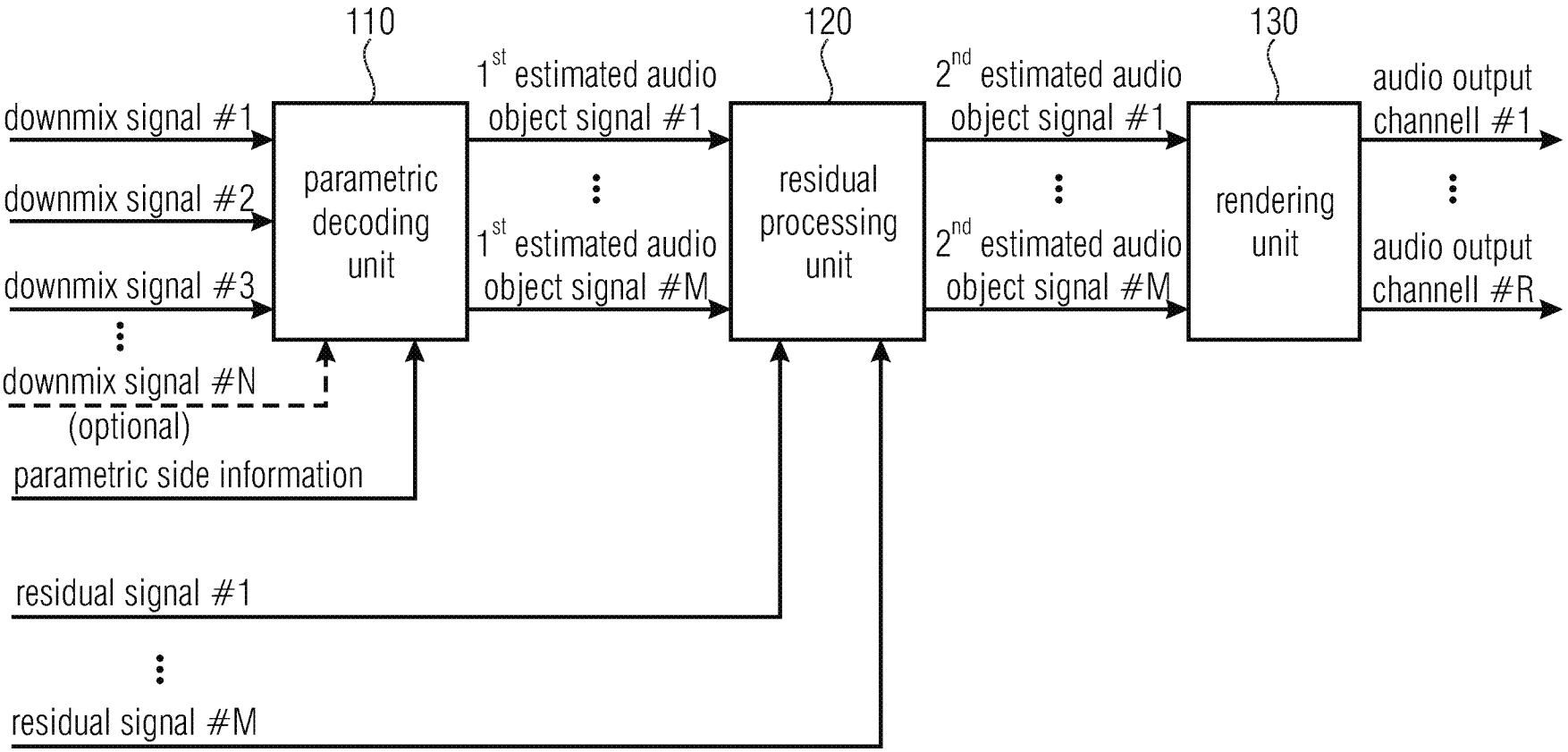
FIG. 1*b* illustrates a decoder according to another embodiment, wherein the decoder further comprises a renderer.

FIG. 1*b* illustrates a decoder according to another embodiment, wherein the decoder further comprises a rendering unit 130 for generating the plurality of audio output channels (Audio Output Channel #1, . . . , Audio Output Channel #R) from the second estimated audio object signals ($2^{nd}$ Estimated Audio Object Signal #1, . . . $2^{nd}$ Estimated Audio Object Signal #M) depending on rendering information. For example, the rendering information may be a rendering matrix and/or the coefficients of a rendering matrix and the rendering unit 130 may be configured to apply the rendering matrix on the second estimated audio object signals ($2^{nd}$ Estimated Audio Object Signal #1, . . . $2^{nd}$ Estimated Audio Object Signal #M) to obtain the plurality of audio output channels (Audio Output Channel #1, . . . , Audio Output Channel #R).

According to an embodiment, the residual processing unit 120 is configured to modify said one or more of the first estimated audio object signals depending on at least three residual signals. The decoder is adapted to generate the at least three audio output channels based on the plurality of second estimated audio object signals.

In another embodiment, each of the one or more residual signals indicates a difference between one of the plurality of original audio object signals and one of the one or more first estimated audio object signals.

According to an embodiment, the residual processing unit 120 is adapted to generate the plurality of second estimated audio object signals by modifying five or more of the first estimated audio object signals. The residual processing unit 120 is adapted to modify said five or more of the first estimated audio object signals depending on five or more residual signals.

In another embodiment, the decoder is configured to generate seven or more audio output channels based on the plurality of second estimated audio object signals.

According to a further embodiment, the decoder is adapted to not determine Channel Prediction Coefficients to determine the plurality of second estimated audio object signals.

In a further embodiment, the decoder is an SAOC decoder.

Figure 3:
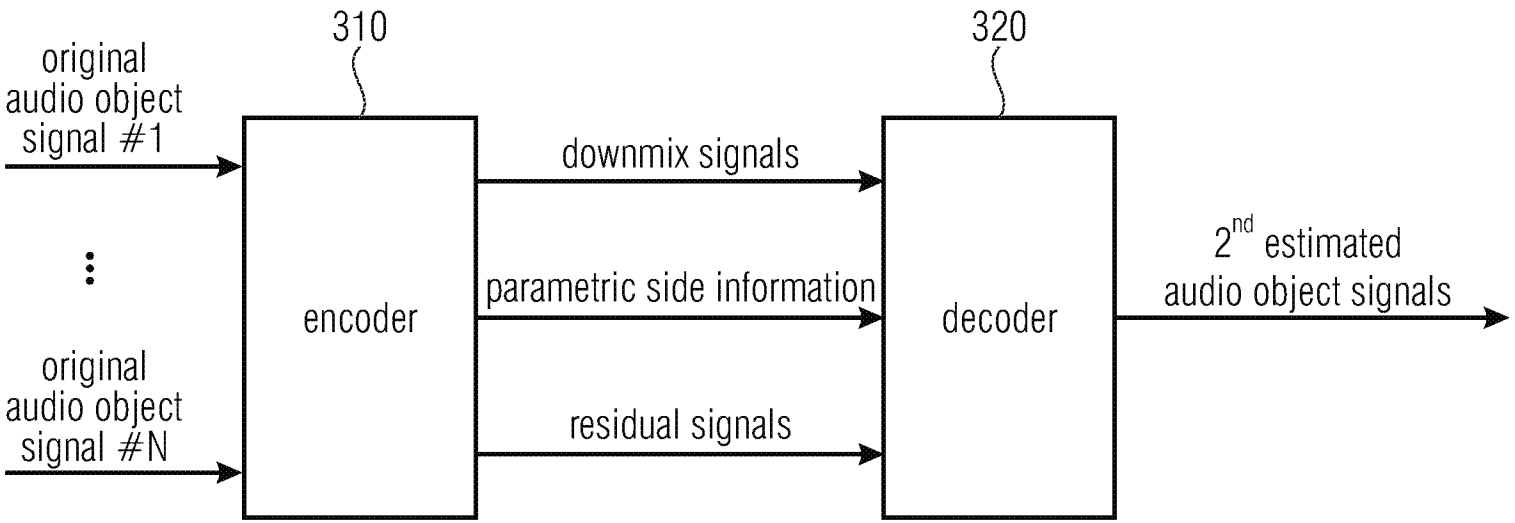
FIG. 3 illustrates a system according to an embodiment.

FIG. 3 illustrates a system according to an embodiment. The system comprises an encoder 310 according to one of the above-described embodiments for encoding a plurality of original audio object signals (Original Audio Object Signal #1, . . . , Original Audio Object Signal #M) by generating three or more downmix signals, by generating parametric side information and by generating a plurality of residual signals. Furthermore, the system comprises a decoder 320 according to one of the above-described embodiments, wherein the decoder 320 is configured to generate a plurality of second estimated audio object signals based on the three or more downmix signals being generated by the encoder 310, based on the parametric side information being generated by the encoder 310 and based on the plurality of residual signals being generated by the encoder 310.

Figure 4:
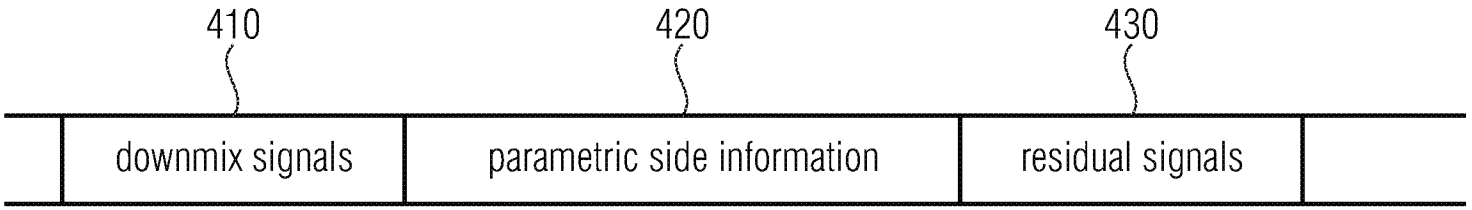
FIG. 4 illustrates an encoded audio signal according to an embodiment.
Figure 5:
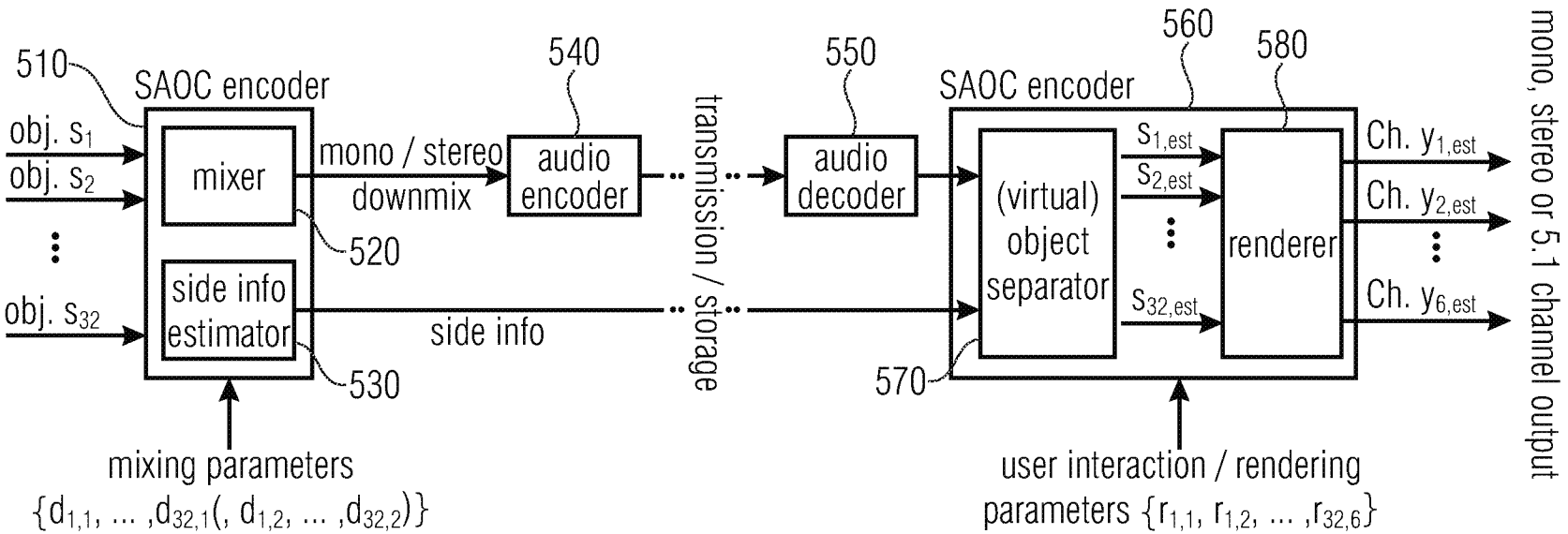
FIG. 5 depicts a SAOC system overview illustrating the principle of such parametric systems using the example of MPEG SAOC.
Figure 6:
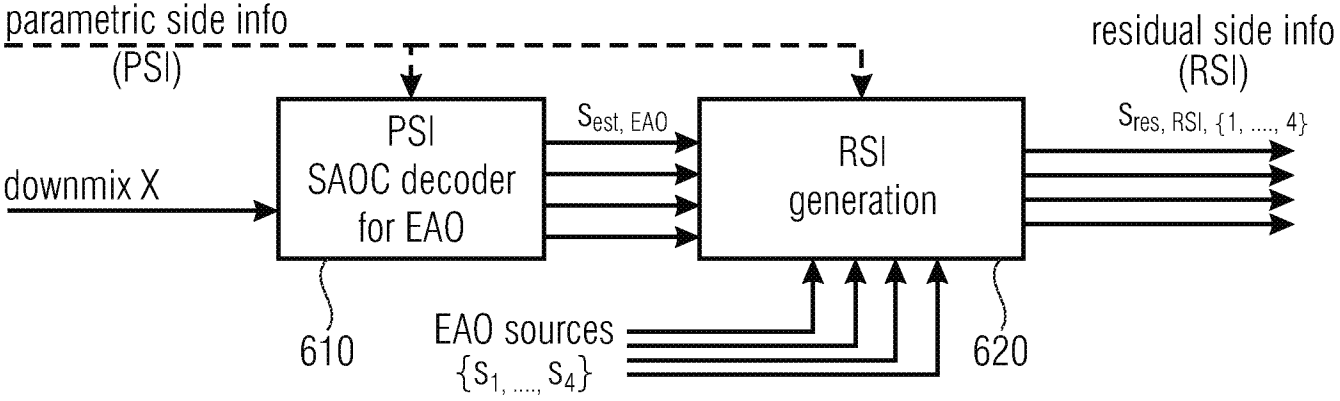
FIG. 6 depicts residual estimation at the encoder side, schematically illustrating the computation of the residual signals for each EAO.
Figure 7:
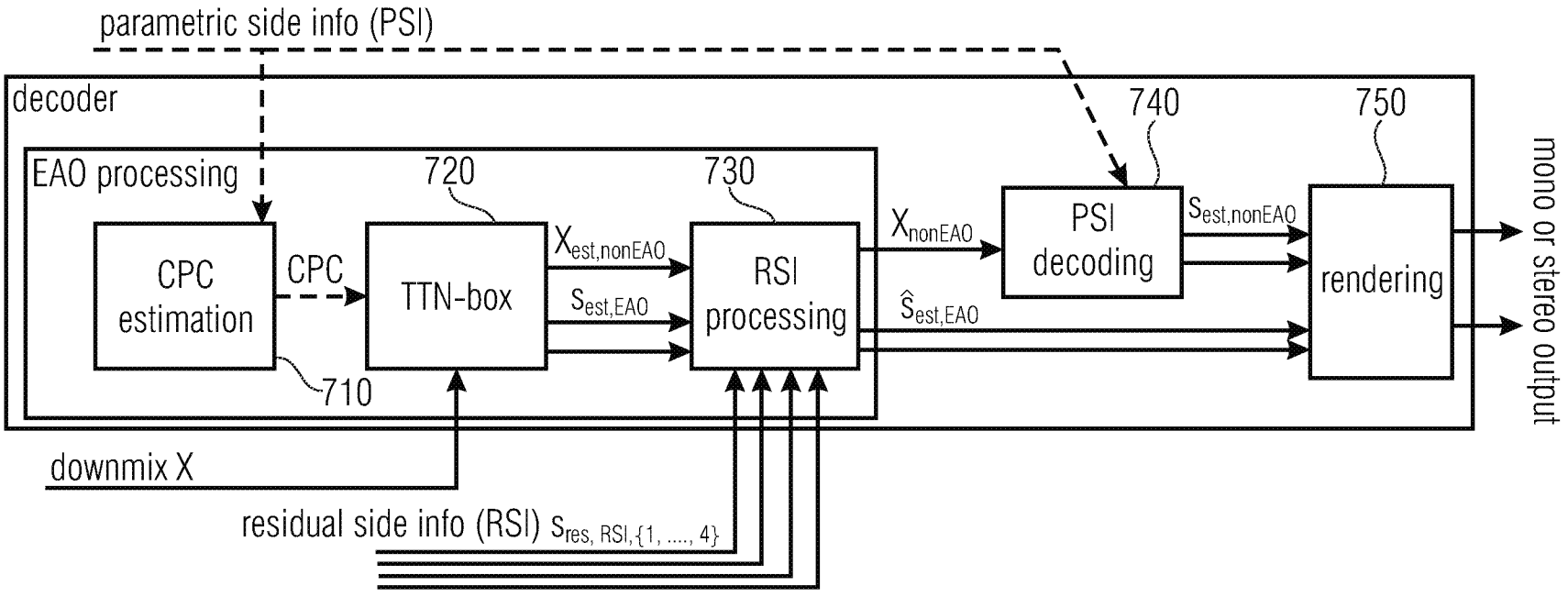
FIG. 7 depicts a basic structure of the SAOC decoder with EAO support, illustrating a conceptual overview of the EAO processing scheme integrated into the SAOC decoding/transcoding chain.

FIG. 4 illustrates an encoded audio signal according to an embodiment. The encoded audio signal comprises three or more downmix signals 410, parametric side information 420 and a plurality of residual signals 430. The three or more downmix signals 410 are a downmix of a plurality of original audio object signals. The parametric side information 420 comprises parameters indicating side information on the plurality of original audio object signals. Each of the plurality of residual signals 430 is a difference signal indicating a difference between one of the plurality of original audio signals and one of a plurality of estimated audio object signals.

In the following, a concept overview according to an embodiment is provided.

Figure 8:
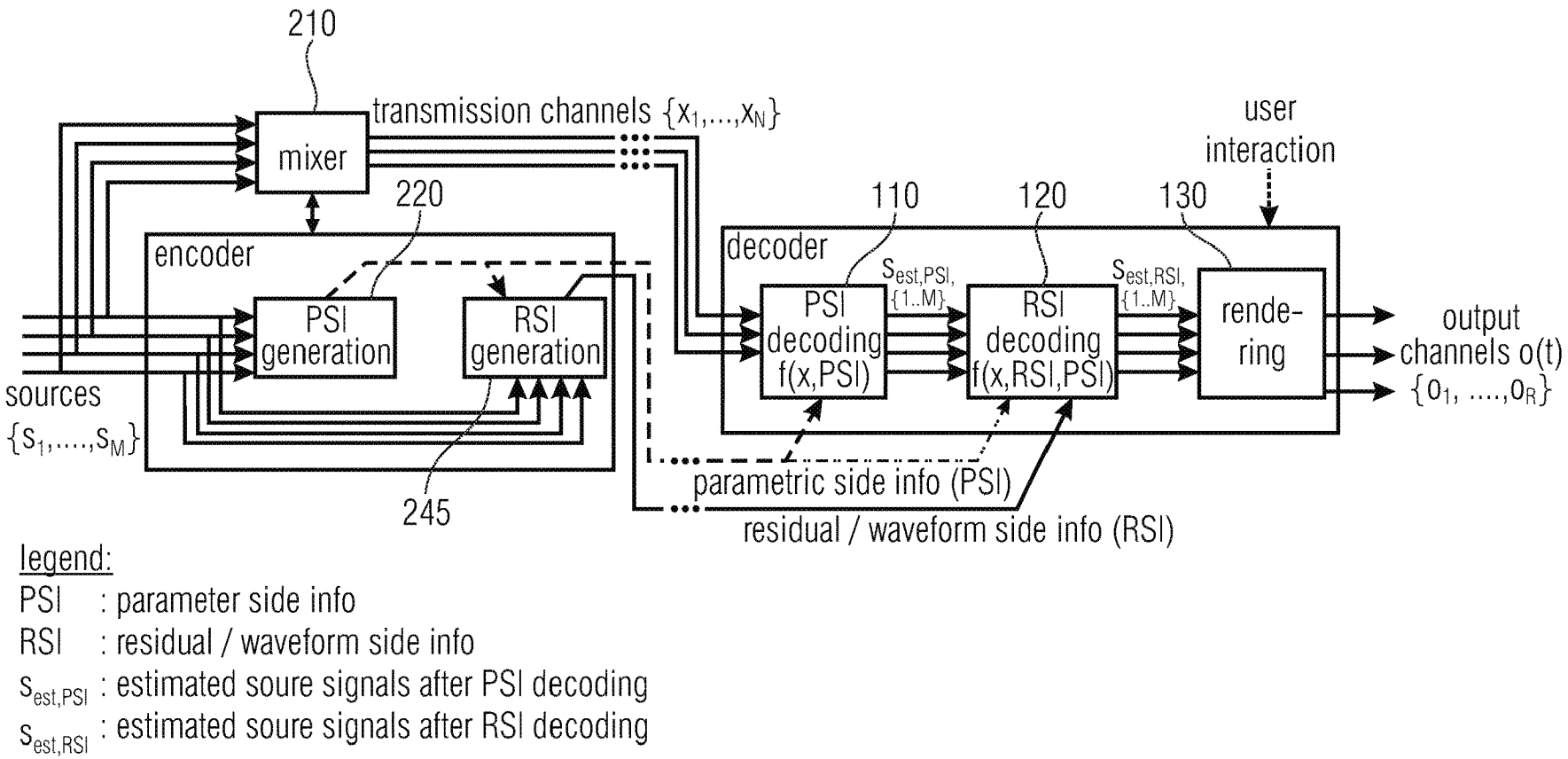
FIG. 8 depicts a conceptual overview of the presented parametric and residual based audio object coding scheme according to an embodiment.

FIG. 8 depicts a conceptual overview of the presented parametric and residual based audio object coding scheme according to an embodiment, wherein the coding scheme exhibits advanced downmix signal and advanced EAO support.

At the encoder side, a parametric side information estimator ("PSI Generation unit") 220 computes the PSI for estimating the object signals at the decoder exploiting source and downmix related characteristics. An RSI generation unit 245 computes for each object signal to be enhanced residual information by analyzing the differences between the estimated and original object signals. The RSI generation unit 245 may, for example, comprise a parametric decoding unit 230 and a residual estimation unit 240.

At the decoder side, a parametric decoding unit ("PSI Decoding" unit) 110 estimates the object signals from the downmix signals with the given PSI. In a second step, a residual processing unit ("RSI Decoding" unit) 120 uses the RSI to improve the quality of the estimated object signals to be enhanced. All object signals (enhanced and non-enhanced audio objects) may, for example, be passed to a rendering unit 130 to generate the target output scene.

It should be noted that it is not necessitated to take all downmix signals into consideration. Downmix signals can be omitted from the computation if their contribution in estimating or/and estimating and enhancing the object signals can be neglected.

For the ease of comprehension, the processing steps in FIG. 8 and the following figures are visualized as separate processing units. In practice, they can be efficiently combined to reduce the computational complexity.

In the following, a joint residual encoding/decoding concept is provided.

Figure 9:
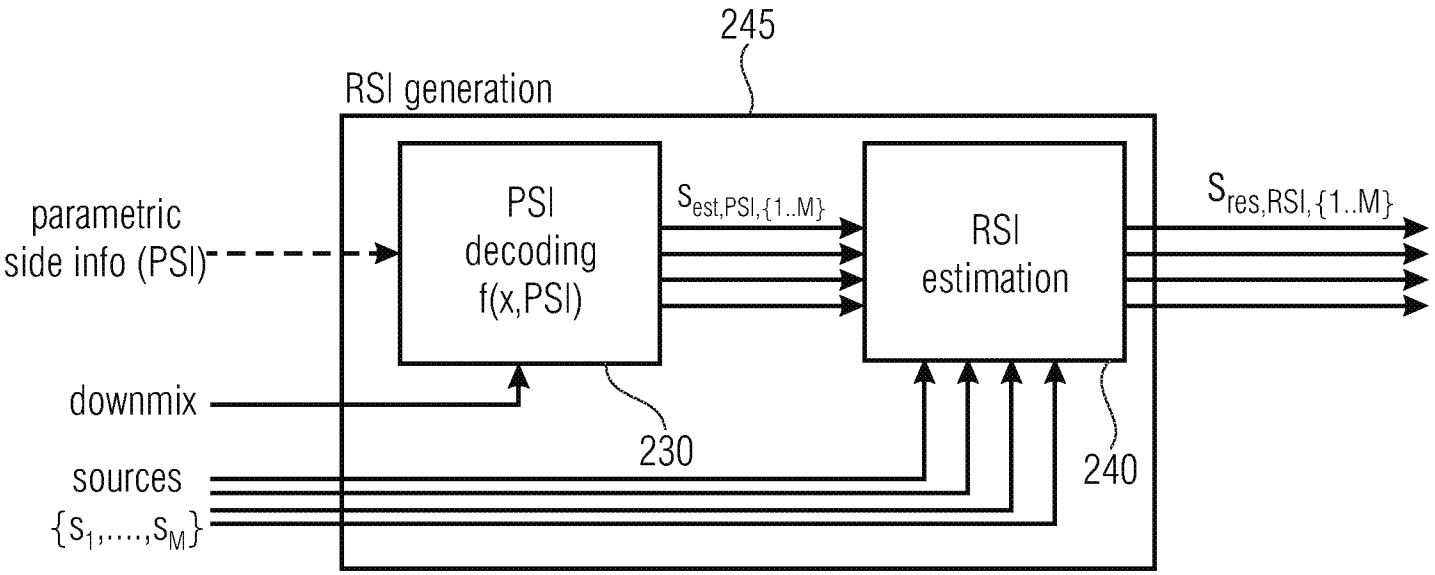
FIG. 9 depicts a concept for jointly estimating the residual signal for each EAO signal at the encoder side according to an embodiment.

FIG. 9 depicts a concept for jointly estimating the residual signal for each EAO signal at the encoder side according to an embodiment.

The parametric decoding unit ("PSI Decoding" unit) 230 yields an estimate of the audio object signals (estimated audio object signals $s_{est,PSI,\{1,\ldots,M\}}$ given the estimated PSI and the downmix signal(s) as input. The estimated audio object signals $s_{est,PSI\{1,\ldots,M\}}$ are compared with the original unaltered source signals $s_1, \ldots, s_M$ in the residual estimation unit ("RSI Estimation" unit) 240. The residual estimation unit 240 provides a residual/error signal term $s_{res,RSI,\{1,\ldots,M\}}$ for each audio object to be enhanced.

Figure 10:
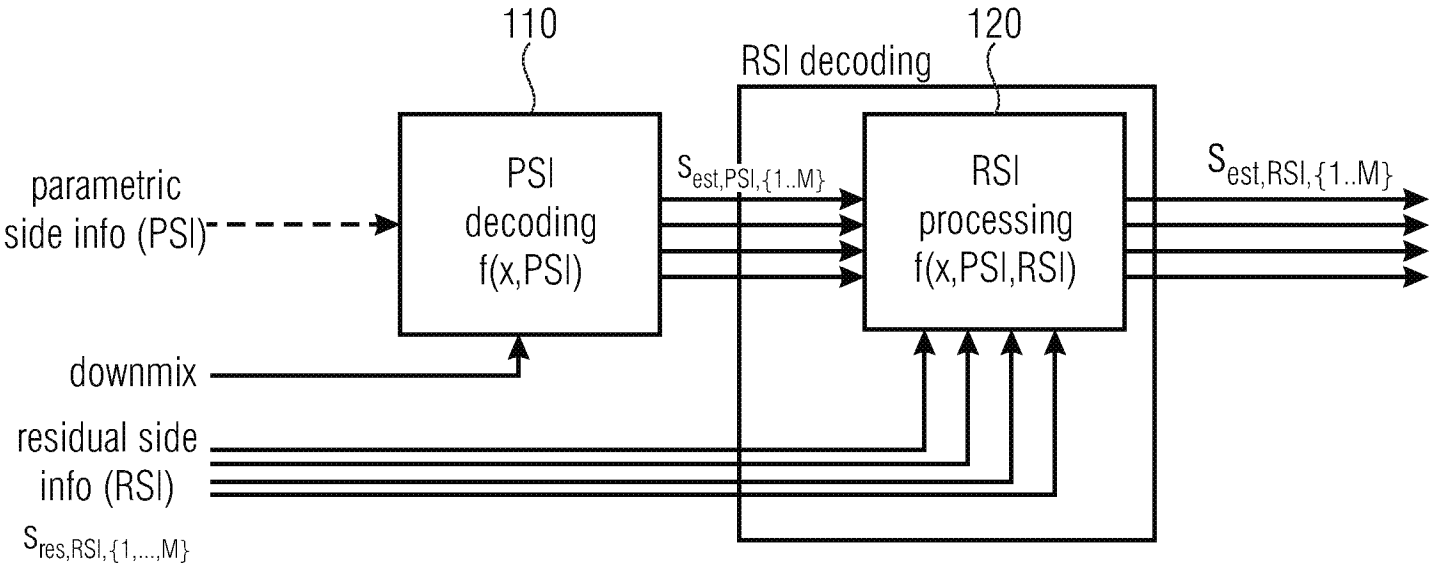
FIG. 10 illustrates a concept of joint residual decoding at the decoder side according to an embodiment.

FIG. 10 displays the "RSI Decoding" unit used in combination with the joint residual computation in the decoder. In particular, FIG. 10 illustrates a concept of joint residual decoding at the decoder side according to an embodiment.

The (first) estimated audio object signals $s_{est,PSI,\{1,\ldots,M\}}$ from the parametric decoding unit ("PSI Decoding" unit) 110 are fed together with the residual information ("residual side information") into the residual processing unit ("RSI Decoding") 120. The residual processing unit 120 computes from the residual (side) information and the estimated audio object signals $s_{est,RSI,\{1,\ldots,M\}}$ the second estimated audio object signals $s_{est,RSI,\{1,\ldots,M\}}$, e.g., the enhanced and non-enhanced audio object signals, and yields the second estimated audio object signals $s_{est,RSI,\{1,\ldots,M\}}$, e.g., the enhanced and non-enhanced audio object signals, as output of the residual processing unit 120.

Additionally, a re-estimation of the non-EAOs can be carried out (not illustrated in FIG. 10). The EAOs are removed from the signal mixture and the remaining non-EAOs are re-estimated from this mixture. This yields an improved estimation of these objects compared to the estimation from the signal mixture that comprises all objects signals. This re-estimation can be omitted, if the target is to manipulate only the enhanced object signals in the mixture.

Figure 11:
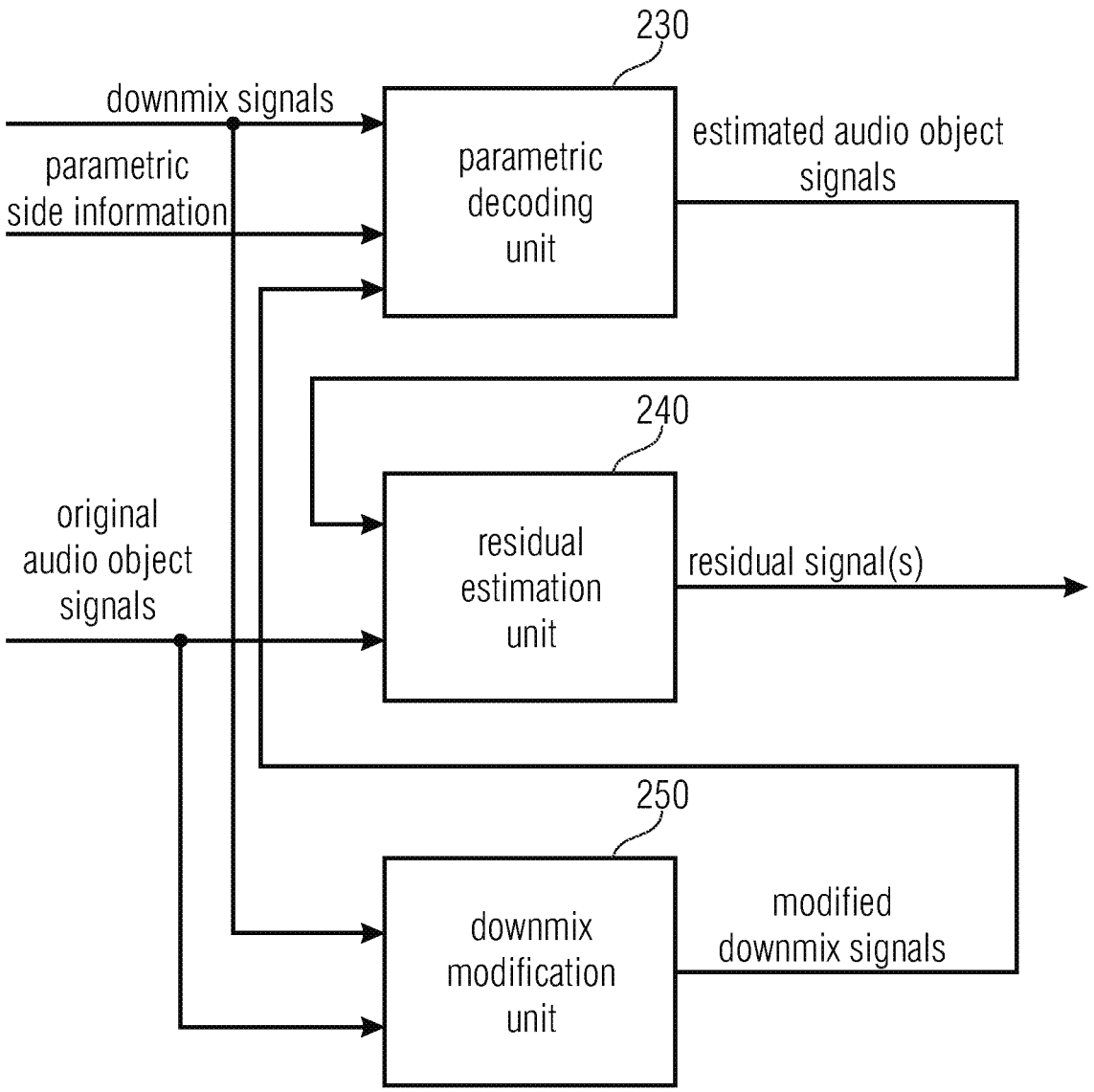
FIG. 11 illustrates a residual signal generator according to an embodiment, wherein the residual signal generator further comprises a downmix modification unit.

FIG. 11 illustrates a residual signal generator according to an embodiment, wherein.

In FIG. 11, the residual signal generator 200 further comprises a downmix modification unit 250 being adapted to modify the three or more downmix signals to obtain three or more modified downmix signals.

The parametric decoding unit 230 is configured to determine one or more audio object signals of the first estimated audio object signals based on the three or more modified downmix signals.

Then, the residual estimation unit 240 may, e.g., determine one or more residual signals based on said one or more audio object signals of the first estimated audio object signals.

In an embodiment, the downmix modification unit 250 may, for example, be configured to modify the three or more original downmix signals to obtain the three or more modified downmix signals, by removing one or more of the plurality of original audio object signals from the three or more original downmix signals.

In another embodiment, the downmix modification unit 250 may, for example, be configured to modify the three or more original downmix signals to obtain the three or more modified downmix signals by generating one or more modified audio object signals based on one or more of the estimated audio object signals and based on one or more of the residual signals, and by removing the one or more modified audio object signals from the three or more original downmix signals. E.g. each of the one or more modified audio object signals may be generated by the downmix modification unit by modifying one of the estimated audio object signals, wherein the downmix modification unit may be adapted to modify said estimated audio object signal depending on one of the one or more residual signals.

In both of the embodiments described above, the downmix modification unit may, for example, be adapted to apply the formula $$\tilde{X}=X-DZ_{eao}*S_{eao},$$

wherein X is the downmix to be modified, wherein D indicates the related downmixing information, wherein $S_{eao}$ comprises the original audio object signals to be removed or the modified audio object signals to be removed, wherein $Z_{eao}*$ indicates the locations of the signals to be removed, and wherein $\tilde{X}$ is the modified downmix signal.

E.g., a location (position) of an audio object signal corresponds to the location (position) of its audio object in the list of all objects.

Figure 12:
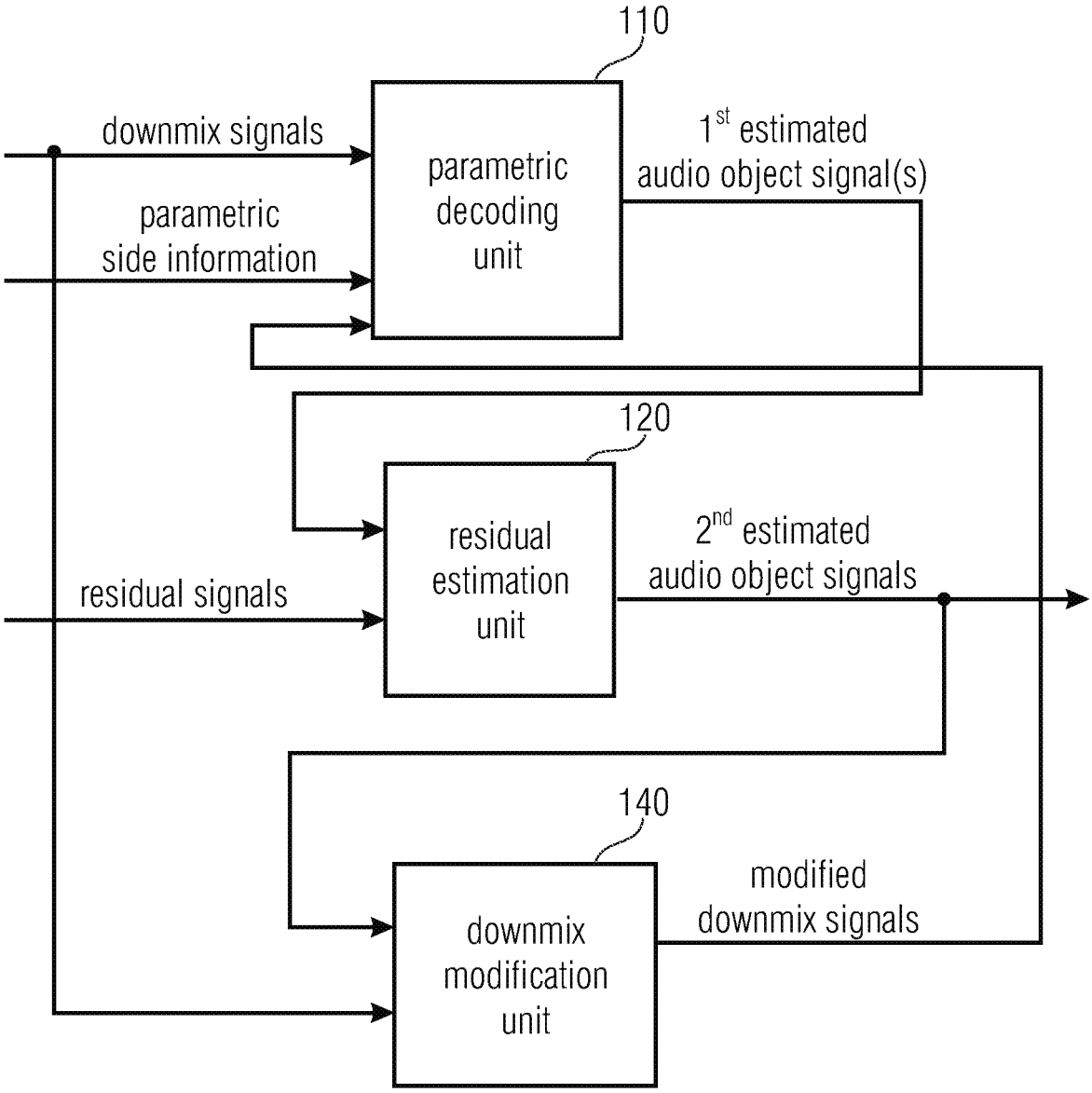
FIG. 12 illustrates a decoder according to an embodiment, wherein the decoder further comprises a downmix modification unit.

FIG. 12 illustrates a decoder according to an embodiment.

In the embodiment of FIG. 12, the decoder further comprises a downmix modification unit 140.

The residual processing unit 120 determines one or more audio object signals of the plurality of second estimated audio object signals.

The downmix modification unit 140 is adapted to remove the determined one or more second estimated audio object signals from the three or more downmix signals to obtain three or more modified downmix signals.

The parametric decoding unit 110 is configured to determine one or more audio object signals of the first estimated audio object signals based on the three or more modified downmix signals.

The residual processing unit 120 may then e.g., determine one or more further second estimated audio object signals based on the determined one or more audio object signals of the first estimated audio object signals.

In a particular embodiment, the downmix modification unit 130 may, for example, be adapted to apply the formula:

$$\tilde{X}_{nonEAO}=X-DZ_{eao}*S_{eao}.$$

to remove the one or more audio object signals of the plurality of second estimated audio object signals determined by the residual processing unit 120 from the three or more downmix signals to obtain three or more modified downmix signals, wherein X indicates the three or more downmix signals before being modified $\tilde{X}_{nonEAO}$ indicates the three or more modified downmix signals D indicates a downmix matrix $Z_{eao}$ indicates a mapping sub-matrix denoting the positions (locations) of EAOs (For more details on particular variants of this embodiment, see the description below).

In the following, a cascaded residual encoding/decoding concept is presented.

Figure 13:
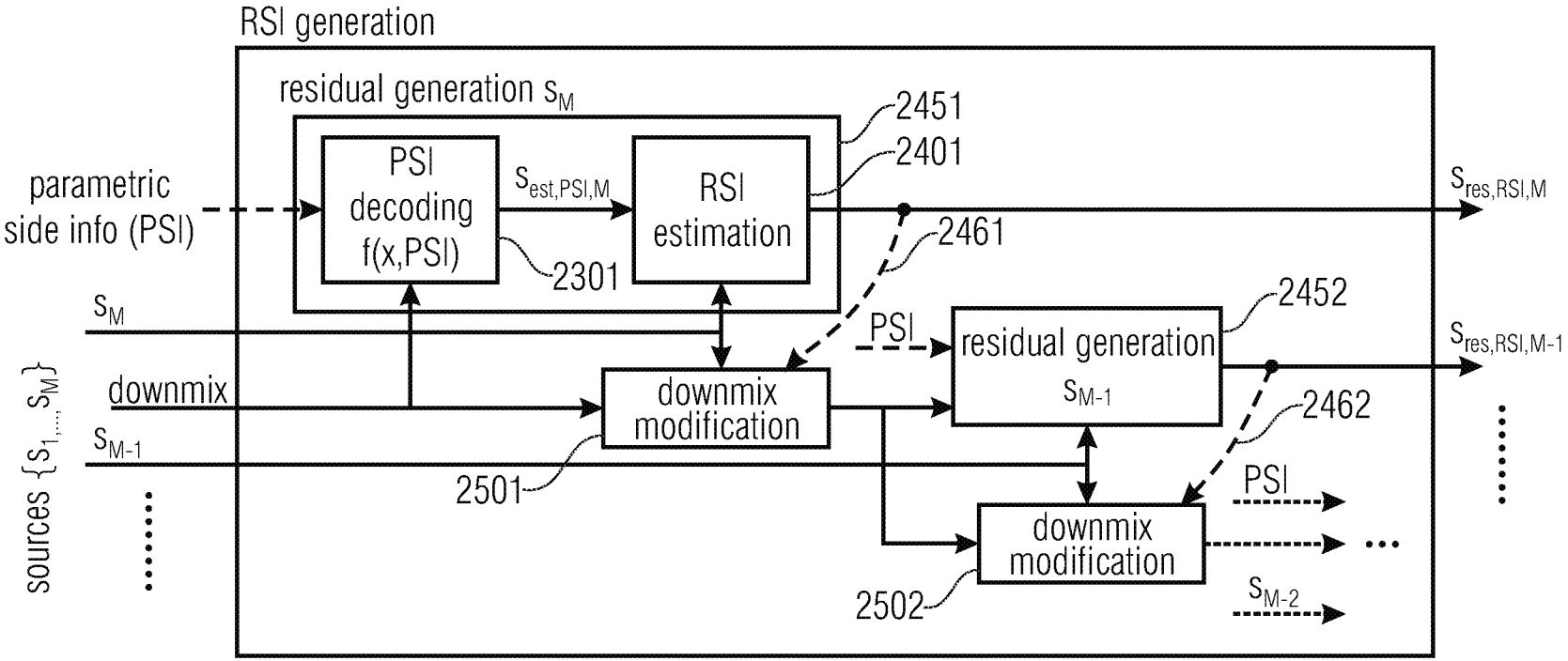
FIG. 13 illustrates a concept of computing the residual components in a cascaded way at an encoder side according to an embodiment.

FIG. 13 illustrates a concept of computing the residual components in a cascaded way at an encoder side according to an embodiment. Compared to the joint residual computation concept, the cascaded approach reduces in each iteration step the energy of the residual energy at the cost of higher computational complexity. In each step, one of the original audio object signals ($s_M$) (or, in an alternative embodiment, an estimated audio object signal; see the dashed-line arrows 2461, 2462) of an enhanced audio object is removed from the signal mixture (downmix) before the signal mixture (downmix) is passed to the next processing unit 2452. In this way the number of object signals in the signal mixture (downmix) decreases with each processing step. The estimation of the enhanced audio object signal (the second estimated audio object signal) in the next step thereby improves, thus successively reducing the energy of the residual signals.

(It should be noted, that in the alternative embodiment, where in each iteration step, an estimated audio object signal is removed from the signal mixture, the downmix modification subunits 2501, 2502 do not need to receive the original audio object signals $s_M$.

On the contrary, in the embodiment, where in each iteration step, an original audio object signal is removed from the signal mixture, the downmix modification subunits 2501, 2502 do not need to receive the estimated audio object signals.)

In more detail, FIG. 13 illustrates a plurality of RSI generation subunits 2451, 2452. The plurality of RSI generation subunits 2451, 2452 together form an RSI generation unit.

Each of the plurality of RSI generation subunits 2451, 2452 comprises a parametric decoding subunit 2301. The plurality of parametric decoding subunits 2301 together form a parametric decoding unit. The parametric decoding subunits 2301 generate the first estimated audio object signals $s_{est,PSI,\{1,\ldots,M\}}$.

Each of the plurality of RSI generation subunits 2451, 2452 comprises a residual estimation subunit 2401. The plurality of residual estimation subunits 2401 together form a residual estimation unit. The residual estimation subunits 2401 generate the second estimated audio object signals $s_{est,RSI,M}$, $s_{est,RSI,M-1}$.

Moreover, FIG. 13 illustrates a plurality of downmix modification subunits 2501, 2502. Each of the downmix modification subunits 2501, 2502 together form a downmix modification unit.

Figure 14:
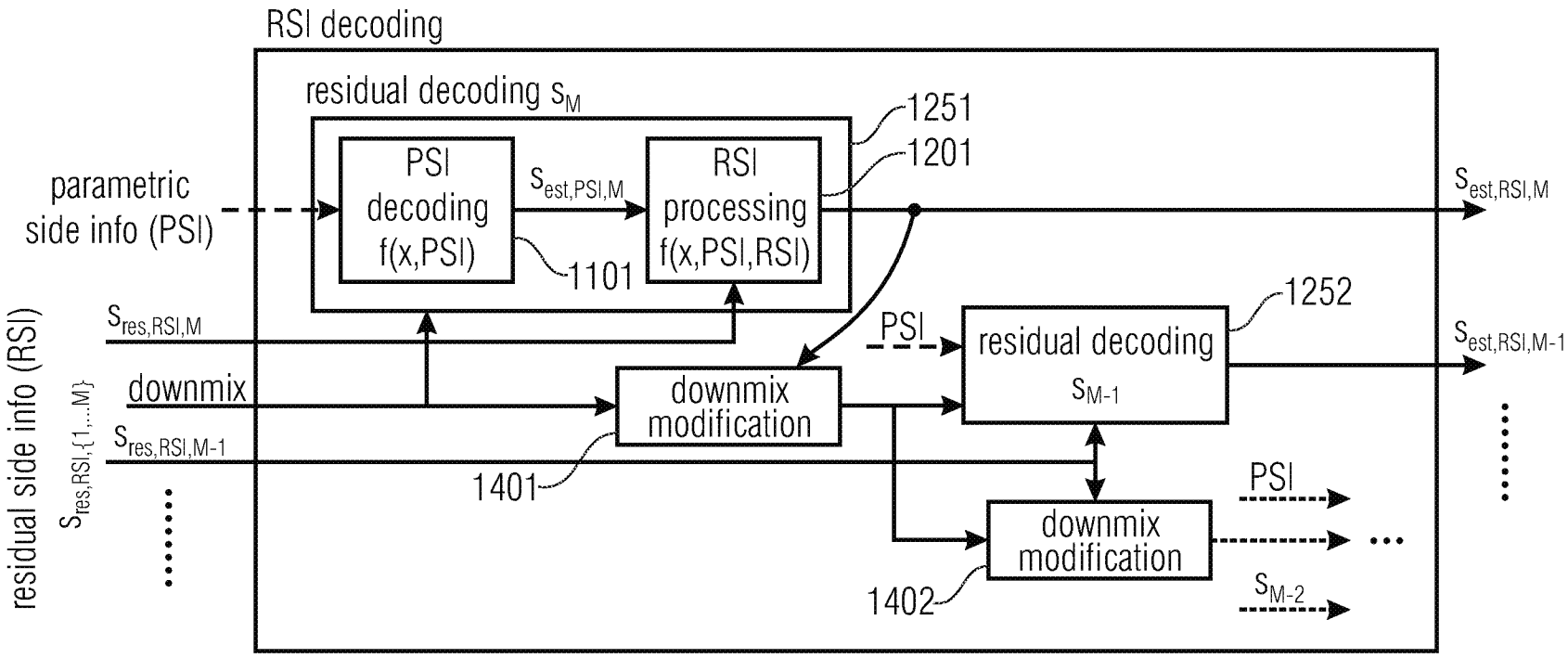
FIG. 14 illustrates the cascaded "RSI Decoding" unit employed in combination with the cascaded residual computation at the decoder side according to an embodiment.

FIG. 14 displays the cascaded "RSI Decoding" unit employed in combination with the cascaded residual computation at the decoder side according to an embodiment.

In each step, one of the object signals to be enhanced is estimated by a parametric decoding subunit ("PSI Decoding) 1101 (to obtain one of the first estimated audio object signals $s_{est,PSI,M}$), and the one of the first estimated audio object signals $s_{est,PSI,M}$ is then processed together with the corresponding residual signal $s_{res,RSI,M}$ by a residual processing subunit ("RSI Processing") 1201, to yield the enhanced version of the object signal (one of the second estimated audio object signals) $s_{est,RSI,M}$. The enhanced object signal $s_{est,RSI,M}$ is cancelled from the downmix signal by a downmix modification subunit ("Downmix modification") 1401 before the modified downmix signals are fed into the next residual decoding subunit ("Residual Decoding") 1252.

Equal to the joint residual encoding/decoding concept, the non-EAOs can additionally be re-estimated.

In more detail, FIG. 14 illustrates a plurality of residual decoding subunits 1251, 1252. The plurality of residual decoding subunits 1251, 1252 together form a residual decoding unit.

Each of the plurality of residual decoding subunits 1251, 1252 comprises a parametric decoding subunit 1101. The plurality of parametric decoding subunits 1101 together form a parametric decoding unit. The parametric decoding subunits 1101 generate the first estimated audio object signals $s_{est,PSI,\{1,\ldots,M\}}$.

Each of the plurality of residual decoding subunits 1251, 1252 comprises a residual processing subunit 1201. The plurality of residual processing subunits 1201 together form a residual processing unit. The residual processing subunits 1201 generate the second estimated audio object signals $s_{est,RSI,M}$, $s_{est,RSI,M-1}$.

Moreover, FIG. 14 illustrates a plurality of downmix modification subunits 1401, 1402. Each of the downmix modification subunits 1401, 1402 together form a downmix modification unit.

Figure 15:
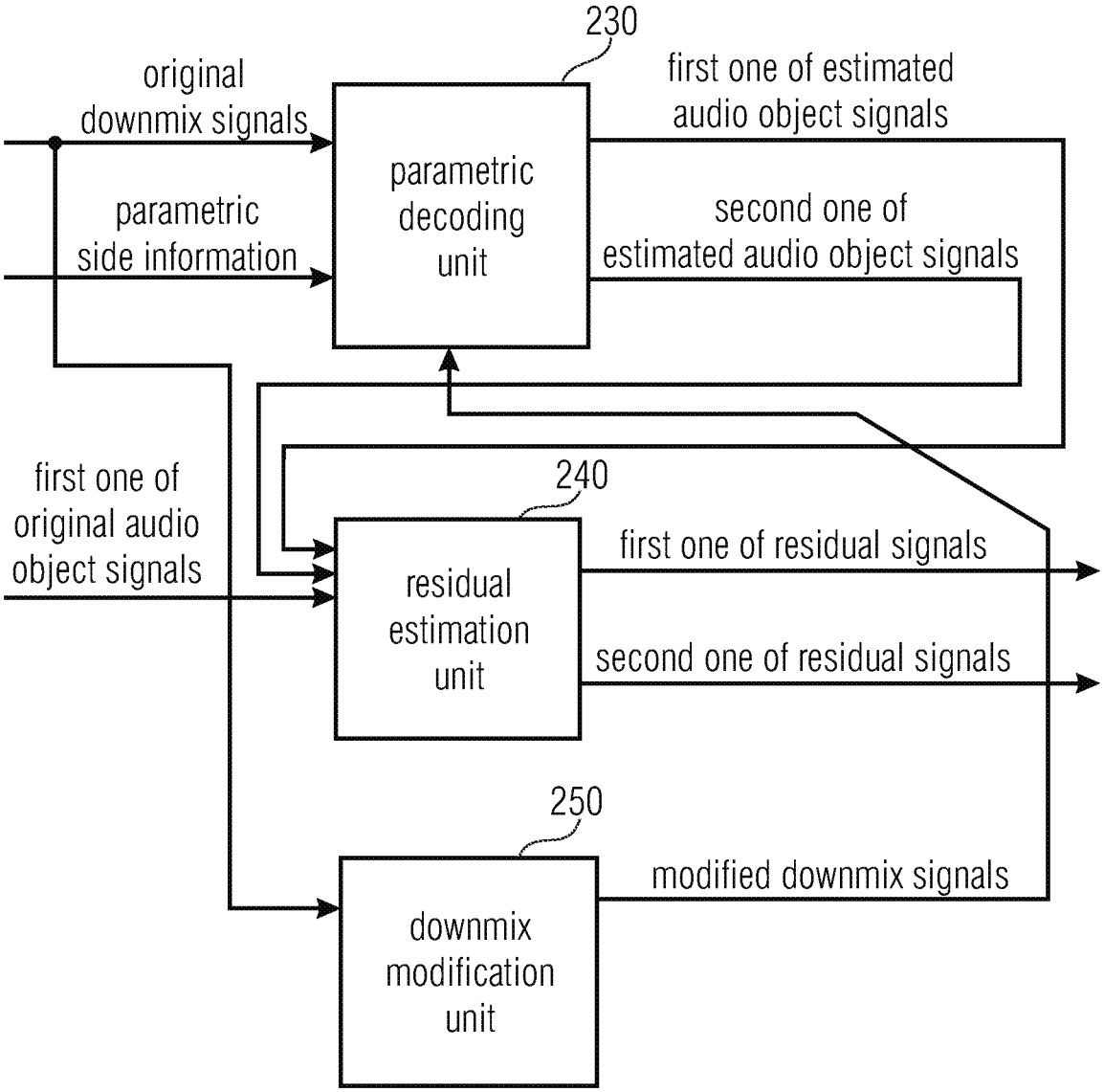
FIG. 15 illustrates a residual signal generator according to an embodiment employing a the cascaded concept.

FIG. 15 illustrates a residual signal generator according to an embodiment employing a the cascaded concept.

In FIG. 15, the residual signal generator comprises a downmix modification unit 250.

The residual signal generator 200 is adapted to conduct two or more iteration steps:

For each iteration step, the parametric decoding unit 230 is adapted to determine exactly one audio object signal of the plurality of estimated audio object signals.

Moreover, for said iteration step, the residual estimation unit 240 is adapted to determine exactly one residual signal of the plurality of residual signals by modifying said audio object signal of the plurality of estimated audio object signals.

Furthermore, for said iteration step, the downmix modification unit 250 is adapted to modify the three or more downmix signals.

In the next iteration step following said iteration step, the parametric decoding unit 230 is adapted to determine exactly one audio object signal of the plurality of estimated audio object signals based on the three or more downmix signals which have been modified.

Figure 16:
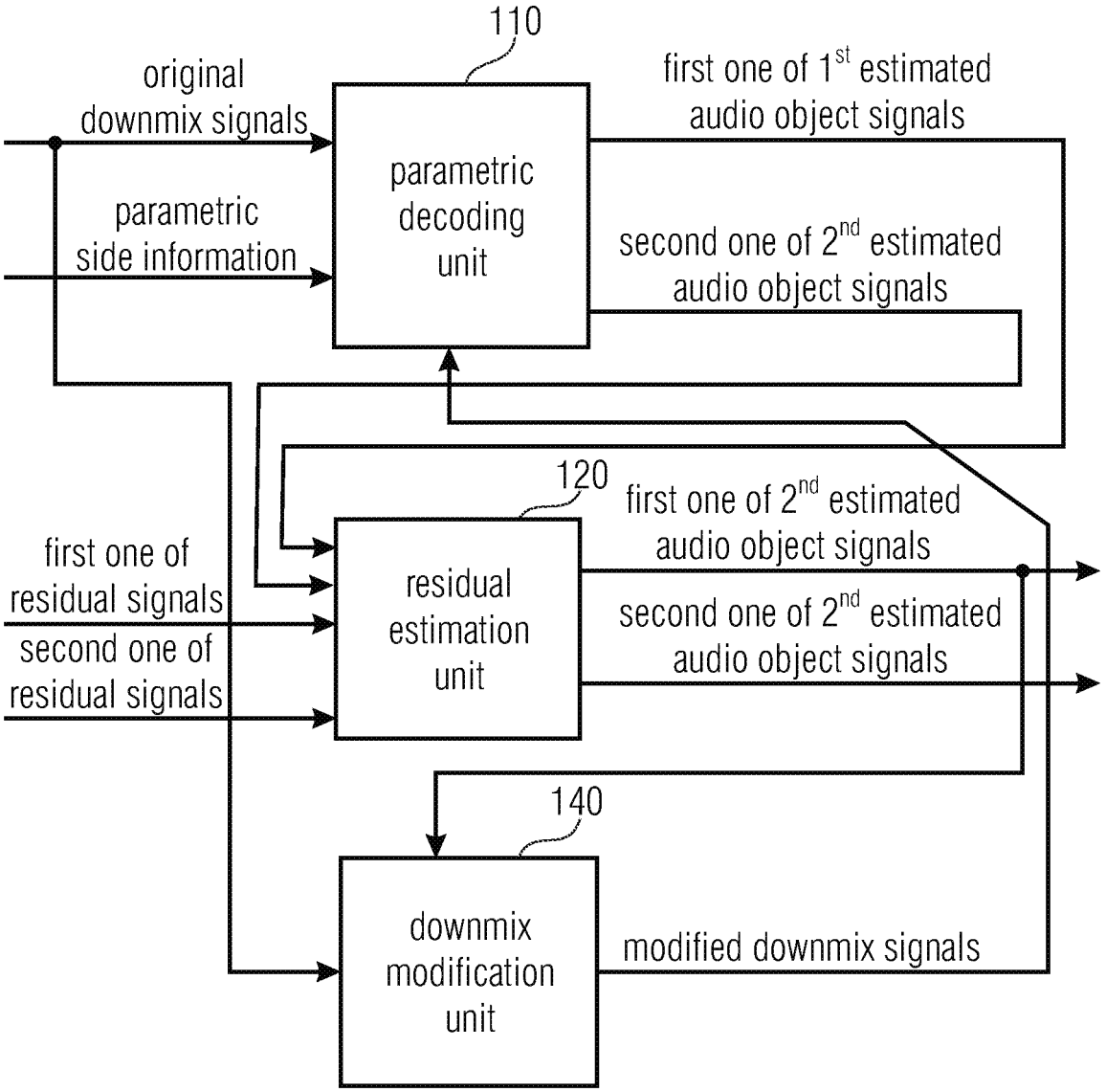
FIG. 16 illustrates a decoder according to an embodiment, employing a cascaded concept.

FIG. 16 illustrates a decoder according to an embodiment, employing a cascaded concept. In FIG. 16, the decoder again comprises a downmix modification unit 140.

The decoder of FIG. 16 is adapted to conduct two or more iteration steps:

For each iteration step, the parametric decoding unit 110 is adapted to determine exactly one audio object signal of the plurality of first estimated audio object signals.

Moreover, for said iteration step, the residual processing unit 120 is adapted to determine exactly one audio object signal of the plurality of second estimated audio object signals by modifying said audio object signal of the plurality of first estimated audio object signals.

Furthermore, for said iteration step, the downmix modification unit 140 is adapted to remove said audio object signal of the plurality of second estimated audio object signals from the three or more downmix signals to modify the three or more downmix signals.

In the next iteration step following said iteration step, the parametric decoding unit 110 is adapted to determine exactly one audio object signal of the plurality of first estimated audio object signals based on the three or more downmix signals which have been modified.

In the following, a mathematical derivation on the example of the joint residual encoding/decoding concept is described:

The following notation is used in the following:

Dimensions:

$N_{Objects}$—number of audio object signals $N_{DmxCH}$—number of downmix signals $N_{UpmixCh}$—number of upmix channels $N_{Samples}$—number of processed data $N_{EAO}$—number of EAOs Terms $Z^*$—the star-operator (*) denotes the conjugate transpose of the given matrix S—original audio object signal provided to encoder (size $N_{Objects}\times N_{Samples}$)

D—downmix matrix (size $N_{DmxCh}\times N_{Objects}$)

R—rendering matrix (size $N_{UpmixCh}\times N_{Objects}$)

X—downmix audio signal X=DS (size $N_{DmxCh}\times N_{Samples}$)

Y—ideal audio output signal Y=RS (size $N_{UpmixCh}\times N_{Samples}$)

$S_{est}$—parametrically reconstructed object signal approximating $S_{est}\square S$ defined as $S_{est}=GX$ (size $N_{Objects}\times N_{Samples}$)

$\hat{S}_{est}$—decoder output comprising all non-EAO (parametrically estimated) and EAO (parametrically plus residual) signal estimates size $N_{Objects}\times N_{Samples}$ $\hat{Y}_{est}$—upmix audio output signal approximating $\hat{Y}_{est}\square Y$ defined as $\hat{Y}_{est}=R\hat{S}_{est}$ (size $N_{UPmixCh}\times N_{Samples}$)

$Z_{nonEao}$; $Z_{eao}$—mapping sub-matrix denoting the locations of non-EAOs and EAOs in the list of all objects. Note $Z_{nonEao}Z_{eao}^*=[0]$(size $(N_{Objects}-N_{EAO})\times N_{Objects}$; $N_{EAO}\times N_{Objects}$). The non-EAO $Z_{nonEao}$ and corresponding $Z_{eao}$ mapping matrices are defined as $$Z_{nonEao}(i,j)=\begin{cases}1, & \text{if object } j \text{ is the } i\text{-th non-}EAO,\\ 0, & \text{otherwise,}\end{cases}$$

$$Z_{eao}(i,j)=\begin{cases}1, & \text{if object } j \text{ is the } i\text{-th } EAO,\\ 0, & \text{otherwise.}\end{cases}$$

For example, for $N_{Objects}=5$ and the objects number 2 and 4 are EAOs, these matrices are $$Z_{nonEao}=\begin{pmatrix}1&0&0&0&0\\0&0&1&0&0\\0&0&0&0&1\end{pmatrix},$$

$$Z_{eao}=\begin{pmatrix}0&1&0&0&0\\0&0&0&1&0\end{pmatrix}.$$

$D_{nonEao}$—downmix sub-matrix corresponding to non-EAOs, defined as $D_{nonEao}=DZ_{nonEao}^*$ (size $N_{DmxCh}\times(N_{Objects}-N_{EAO})$)

$D_{eao}$—downmix sub-matrix corresponding to EAOs, defined as $D_{eao}=DZ_{eao}^*$ (size $N_{DmxCh}\times N_{EAO}$)

G—parametric source estimation matrix (size $N_{Objects}\times N_{DmxCh}$)

E—object covariance matrix (size $N_{Objects}\times N_{Objects}$)

$E_{nonEao}$—covariance sub-matrix corresponding to non-EAOs, defined as $E_{nonEao}=Z_{nonEao}EZ_{nonEao}^*$(size $(N_{Objects}-N_{EAO})\times(N_{Objects}-N_{EAO})$)

$S_{eao}$— EAO signal comprising the reconstructions of the EAOs (size $N_{EAO}\times N_{Samples}$)

$S_{nonEao}$—non-EAO signal comprising the reconstructions of the non-EAOs (size $(N_{Objects}-N_{EAO})\times N_{Samples}$)

$S_{res}$—residual signals for EAOs (size $N_{EAO}\times N_{Samples}$)

$\hat{X}_{nonEao}$-modified downmix signal comprising only non-EAO signals; computed as the difference between SAOC downmix and downmix of reconstructed EAOs (size $N_{DmxCh}\times N_{Samples}$)

All introduced matrices are (in general) time and frequency variant.

Now, a general method with non-EAO signal re-estimation at the decoder side is considered:

The general method can be described as a two-step approach with first extracting all EAO signals from the corresponding downmix signal, and then reconstructing all non-EAO signals considering the EAOs. The object signals are recovered from the downmix signal (X) using the PSI (E, D) and incorporated residual signal ($S_{res}$).

It is considered that the final rendered output signal $\hat{Y}_{est}$ is given as:

$$Y_{est}=R\hat{S}_{est}.$$

The decoder output object signal $\hat{S}_{est}$ can be represented as following sum:

$$\hat{S}_{est}=Z^*_{eao}S_{eao}+Z_{nonEao}^*S_{nonEao}.$$

The EAO signal $S_{eao}$ is computed from the downmix X with the help of the parametric EAO reconstruction matrix $G_{eao}$ and the corresponding EAO residuals $S_{res}$ as follows:

$$S_{eao}=G_{eao}X+S_{res}.$$

The non EAO signal $S_{nonEao}$ is computed from the modified downmix $\tilde{X}_{nonEao}$ with the help of parametric non-EAO reconstruction matrix $\tilde{G}_{nonEao}$ as follows:

$$S_{nonEao}=\tilde{G}_{nonEao}\tilde{X}_{nonEao}.$$

The modified downmix $\tilde{X}_{nonEao}$ signal is determined as the difference between the downmix X and the corresponding downmix of the reconstructed EAOs as follows, thus cancelling the EAOs from the downmix signal X:

$$\tilde{X}_{nonEAO}=X-DZ_{eao}^*S_{eao}.$$

Here the parametric object reconstruction matrices for EAOs $G_{eao}$ and non-EAOs $\tilde{G}_{nonEao}$ are determined using the PSI (E, D) as follows:

$$G_{eao}=Z_{eao}ED^*J,\ J\approx(DED^*)^{-1},$$

$$\tilde{G}_{nonEao}=E_{nonEao}D_{nonEao}^*J_{nonEao}J_{nonEao}\approx(D_{nonEao}E_{nonEao}D_{nonEao}^*)^{-1}.$$

In the following, a simplified method "A" without non-EAO signal re-estimation at the Decoder side is described:

If only EAOs in the signal mixture are manipulated, the target scene can be interpreted as a linear combination of the downmix signals and the EAO signals. The additional re-estimation of the non-EAO signals can therefore be omitted. The general method with non-EAO signal re-estimation can be simplified to a single-step procedure:

$$S_{est}=S_{est}+X_{dif}.$$

The signal $X_{dif}=f(S_{res},D)$ comprises the transmitted residual signals of the EAOs and residual compensation terms so that the following definition holds:

$$D\hat{S}_{est}=X.$$

This condition is sufficient to render any acoustic scene, which is restricted to manipulate the EAOs only.

With $D\hat{S}_{est}=D\ (S_{est}+X_{dif})=X$ and $DS_{est}=X$, the following constraint for the term $X_{dif}$ has to be fulfilled:

$$DX_{dif}=0.$$

The term $X_{dif}$ consists of components which are determined by the encoder (and transmitted or stored) $S_{res}$ and components $X_{nonEao}$ to be determined using this equation.

Using the definitions of the downmix matrix ($D=D_{eao}Z_{eao}+D_{nonEao}Z_{nonEao}$) and the compensation term ($X_{dif}=Z_{eao}*S_{res}+Z*_{nonEao}\ X_{nonEao}$) one can derive the following equation:

$$\begin{aligned}DX_{dif}=&D_{eao}Z_{eao}Z_{eao}*S_{res}+\\&D_{nonEao}Z_{nonEao}Z_{nonEao}*X_{nonEao}+\\&D_{eao}Z_{eao}Z_{nonEao}*X_{nonEao}+\\&D_{nonEao}Z_{nonEao}Z_{eao}*S_{res}=0\end{aligned}$$

With $Z_{eao}Z_{eao}*=I$, $Z_{nonEao}Z_{nonEao}*=I$ and $Z_{nonEao}Z_{eao}*=[0]$, $Z_{eao}Z_{nonEao}*=[0]$, the equation can be simplified to:

$$D_{eao}S_{res}+D_{nonEao}X_{nonEao}=0.$$

Solving the linear equation for $X_{nonEao}$ gives:

$$X_{nonEao}=-(D_{nonEao}*D_{nonEao})^{-1}D_{nonEao}*D_{eao}S_{res}.$$

After solving this system of linear equations the desired target scene can be calculated as the following sum of parametric prediction term and residual enhancement term as:

$$\hat{Y}_{est}=R\hat{S}_{est},\ \hat{S}_{est}=S_{est}+X_{dif},\ X_{dif}=Z_{eao}*S_{res}-Z_{nonEao}*(D_{nonEao}*D_{nonEao})^{-1}D_{nonEao}*D_{eao}S_{res}.$$

In the following, a simplified method "B" without non-EAO signal re-estimation at the decoder side is provided:

Consider the compensation term $X_{dif}$ as above ($\hat{S}_{est}=S_{est}+X_{dif}$) for the parametric signal prediction $S_{est}$ and represent it as the following function $X_{dif}=H_{enh}Z_{eao}*S_{res}$ of the residual signals $S_{res}$ leading into:

$$\hat{S}_{est}=S_{est}+H_{enh}Z*_{eao}S_{res}$$

An alternative formulation is comprising the three following parts including appropriate linear combination of downmix signals ($H_{dmx}X$), enhanced objects ($H_{enh}Z_{eao}*Z_{eao}S_{enh}$), and non-enhanced objects ($H_{est}S_{est}$) such that it follows:

$$\hat{S}_{est}=H_{dmx}X+H_{enh}Z_{eao}*Z_{eao}S_{enh}+H_{est}S_{est}.$$

The matrices are of the sizes $H_{dmx}$:$N_{Objects}\times N_{DmxCh}$, $H_{enh}$:$N_{Objects}\times N_{Objects}$, $S_{enh}$:$N_{Objects}\times N_{Samples}$, and $H_{est}$: $N_{Objects}\times N_{Objects}$.

Assuming $DS_{est}=X$ and the definition of $S_{enh}=S_{est}+Z_{eao}*S_{res}$ this can be written as:

$$\hat{S}_{est}=(H_{dmx}D+H_{enh}Z_{eao}*Z_{eao}+H_{est})S_{est}+H_{enh}Z_{eao}*S_{res}.$$

Comparing this, and the earlier definition of the reconstructed signals $\hat{S}_{est}=S_{est}+H_{enh}Z_{eao}*Z_{eao}S_{res}$ it follows that:

$$H_{dmx}D+H_{enh}Z_{eao}*Z_{eao}+H_{est}=I.$$

One can derive the term $H_{est}$ as:

$$H_{est}=I-H_{est}D_{est}.$$

The error in the final reconstruction will be minimized, when the contribution of the non-enhanced signals is minimized Thus, targeting for $H_{est}$ □0 allows to solve the term $H_{est}$ from a system of linear equations:

$$H_{est}=D_{est}*(D_{est}D_{est}*)^{-1},$$

where extended downmix matrix $D_{est}$ and upmix matrix $H_{est}$ are defined as concatenated matrices:

$$D_{ext}=\begin{bmatrix}D\\Z_{eao}^{*}Z_{eao}\end{bmatrix}\text{ and}$$

$$H_{ext}=[\,H_{dmx}\quad H_{enh}\,],\text{ and thus}$$

$$H_{enh}=H_{ext}\begin{bmatrix}0^{N_{DmxCh}\times N_{Objects}}\\I^{N_{Objects}\times N_{Objects}}\end{bmatrix}$$

After solving this system of linear equations the desired correction term $X_{dif}$ can be obtained as:

$$X_{dif}=D_{ext}^{*}(D_{ext}D_{ext}^{*})^{-1}\begin{bmatrix}0^{N_{DmxCh}\times N_{Objects}}\\I^{N_{Objects}\times N_{Objects}}\end{bmatrix}Z_{eao}^{*}S_{res},$$

Leading into the final outputs of $\hat{Y}_{est}=R\hat{S}_{est}$, $\hat{S}_{est}=S_{est}+X_{dif}$.

In the following, a simplified method "C" is considered:

If only the EAOs are manipulated in an arbitrary manner, any target scene can be generated by a linear combination of the downmix signals and the EAOs. Note that instead of the downmix, the downmix with the EAOs cancelled can also be used. The target scene can be perfectly generated if the residual processing perfectly restores the EAOs. Rendering of any target scene can be done using finding the two component rendering matrices $R_D$ and $R_{eao}$ for the downmix and the EAO reconstructions. The matrices have the sizes $R_D$: $N_{UpmixCh}\times N_{DmxCh}$ and $R_{eao}$: $N_{UpmixCh}\times N_{EAO}$. The target rendering matrix R can be represented as a product of the combined rendering matrices and the downmix matrix as $$R=[\,R_D\quad R_{eao}\,]\begin{bmatrix}D\\Z_{eao}^{*}Z_{eao}\end{bmatrix}=R_{ext}D_{ext}$$

From this, $R_{ext}$ can be solved with $$R_{ext}=RD_{est}*(D_{est}D_{est}*)^{-1}$$

and the sub-matrices $R_D$ and $R_{eao}$ can be extracted from the solution with $$R_D=R_{ext}\begin{bmatrix}I^{N_{DmxCh}\times N_{DmxCh}}\\0^{N_{Objects}\times N_{DmxCh}}\end{bmatrix}\text{ and}$$

$$R_{eao}=R_{ext}\begin{bmatrix}0^{(N_{Objects}+N_{DmxCh}-N_{EAO})\times N_{EAO}}\\I^{N_{EAO}\times N_{EAO}}\end{bmatrix}$$

The target scene can now be computed as:

$$\hat{Y}_{est}=R_DX+R_{eao}S_{eao},$$

where $S_{eao}$ comprises the full reconstructions of the EAOs and is defined (as earlier) $S_{eao}=G_{eao}X+S_{res}$.

A similar equation can be formulated for rendering the target using the downmix with the EAOs cancelled from the mix by subtracting $D_{eao}S_{eao}$ from the downmix.

In the following, another mathematical derivation and further details on the joint residual encoding/decoding concept are described, and an unification between the general method and the simplification "A" is provided.

From now on in the description, the following notation applies. If for some elements, the following notation is inconsistent with the notation provided above, from now on in the description, only the following notation applies for these elements.

Definitions

S is the object signals of size $N_{Objects} \times N_{Samples}$

E=SS* is the object covariance matrix of size $N_{Objects} \times N_{Objects}$

D is the downmixing matrix of size $N_{DmxCh} \times N_{Objects}$

X=DS is the downmix signal of size $N_{DmxCh} \times N_{Samples}$

G=ED*J is the up-mixing matrix of size $N_{Objects} \times N_{DmxCh}$ $M_{ren}$ is the rendering matrix of size $N_{UpmixCh} \times N_{Objects}$ $X_{res}$ is the residual signals of size $N_{EAO} \times N_{Samples}$ $R_{eao}$ is a matrix of size $N_{EAO} \times N_{Objects}$ denoting the positions (locations) of EAOs defined as $$R_{eao}(i, j) = \begin{cases} 1, & \text{if object } j \text{ is the } ith\ EAO \\ 0, & \text{otherwise} \end{cases}.$$

$R_{nonEao}$ is a matrix of size $(N_{Objects}-N_{EAO}) \times N_{Objects}$ denoting the positions (locations) of non-EAOs defined as $$R_{nonEao}(i, j) = \begin{cases} 1, & \text{if object } j \text{ is the } ith\ \text{non-}EAO \\ 0, & \text{otherwise} \end{cases}.$$

The sub-matrices of some of the above corresponding to non-EAOs can be specified with the help of the selection matrices $R_{nonEao}$ as:

$$\begin{aligned} E_{nonEao} &= R_{nonEao} E R^*_{nonEao} \\ D_{nonEao} &= D R^*_{nonEao} \\ G_{nonEao} &= E_{nonEao} D^*_{nonEao} J_{nonEao} \\ &= E_{nonEao} D^*_{nonEao} (D_{nonEao} E_{nonEao} D^*_{nonEao})^{-1} \\ &= R_{nonEao} E R^*_{nonEao} R_{nonEao} D^* \\ &\quad (D R^*_{nonEao} R_{nonEao} E R^*_{nonEao} R_{nonEao} D^*)^{-1} \end{aligned}$$

In the following, another detailed mathematical description on the general method (with non-EAO signal re-estimation at the decoder) is provided:

The object signals are recovered from the downmix using the side information and incorporated residual signals. The output from the decoder $\hat{X}$ is produced as follows $$\hat{X} = M_{res} R_{eao}{}^* X_{eao} + M_{res} R_{nonEao}{}^* X_{nonEao}.$$

The EAO term $X_{eao}$ of size $N_{EAO}$ with the EAOs is computed as follows $$X_{eao} = R_{eao} ED^* JX + X_{res},$$

where the residual signal term $X_{res}$ of size $N_{EAO}$ comprises the residual signals for EAOs. The non-EAO term $X_{nonEao}$ of size $N_{Objects}-N_{EAO}$ comprising the non-EAOs is computed as $$X_{nonEao} = E_{nonEao} D_{nonEao}{}^* J_{nonEao} \tilde{X}_{nonEao},\ J_{nonEao} \approx (D_{nonEao} E_{nonEao} D_{nonEao}{}^*)^{-1}$$

where the modified downmix signal $\tilde{X}_{nonEao}$ comprising only non-EAO signals is computed as the difference between SAOC downmix and downmix of the reconstructed EAOs $$\tilde{X}_{nonEao} = X - DR_{eao}{}^* X_{eao}.$$

The covariance sub-matrix $E_{nonEAO}$ of size $(N_{Objects}-N_{EAO}) \times (N_{Objects}-N_{EAO})$ corresponding to non-EAOs is computed as $$E_{nonEao} = R_{nonEao} E R_{nonEao}{}^*.$$

The downmix sub-matrix $D_{nonEao}$ of size $N_{DmxCh} \times (N_{Objects}-N_{EAO})$ corresponding to non-EAOs is computed as $$D_{nonEao} = DR_{nonEao}{}^*.$$

In the following, another detailed mathematical description on the simplified method "A" (without non-EAO signal re-estimation at the decoder) is provided:

The object signals are recovered from the downmix using the side information and incorporated residual signals. The final output from the decoder $\hat{X}$ is produced as follows $$\hat{X} = M_{ren}(ED^* JX + X_{dif}).$$

The term $X_{dif}$ of size $N_{Objects}$ incorporates $N_{EAO}$ residual signals $X_{res}$ for EAOs and the predicted term $X_{nonEao}$ for non-EAOs as follows $$X_{dif} = R_{eao}{}^* X_{res} + R_{nonEao}{}^* X_{nonEao}.$$

The predicted term $X_{nonEao}$ is estimated as follows $$X_{nonEao} = -(D_{nonEao}{}^* D_{nonEao})^{-1} D_{nonEao}{}^* D_{eao} X_{res}$$

The downmix sub-matrix $D_{eao}$ corresponding to EAOs and $D_{nonEao}$ corresponding to regular objects are defined as $$D = D_{eao} R_{eao} + R_{nonEao} D_{nonEao}.$$

In the following, a special case of rendering matrix 1 is considered:

Consider the following special case of the downmix-similar rendering matrix $M_D$ of the size $N_{DmxCh} \times N_{Objects}$ with arbitrary modification of the EAOs and only a uniform scaling (compared to the downmix) of the non-EAOs $$M_D = MR_{eao}{}^* R_{eao} + aDR_{nonEao}{}^* R_{nonEao}.$$

Now, a detailed mathematical description of the general method is provided:

$$\begin{aligned} \hat{X} &= M_D(R^*_{eao} X_{eao} + R^*_{nonEao} X_{nonEao}) \\ &= M_D R^*_{eao}(R_{eao} ED^* JX + X_{res}) + \\ &\quad M_D R^*_{nonEao} G_{nonEao}(X - DR^*_{eao} X_{eao}) \\ &= M_D R^*_{eao}(R_{eao} ED^* JX + X_{res}) + \\ &\quad M_D R^*_{nonEao} G_{nonEao}(X - DR^*_{eao}(R_{eao} ED^* JX + X_{res})) \\ &= MR^*_{eao}(R_{eao} ED^* JX + X_{res}) + \\ &\quad aDR^*_{nonEao} G_{nonEao}(X - DR^*_{eao}(R_{eao} ED^* JX + X_{res})) \\ &= MR^*_{eao}(R_{eao} ED^* JX + X_{res}) + \\ &\quad aDR^*_{nonEao} R_{nonEao} ER^*_{nonEao} R_{nonEao} D^* \end{aligned}$$

-continued $$(DR^*_{nonEao}R_{nonEao}ER^*_{nonEao}R_{nonEao}D^*)^{-1}$$
$$(X - DR^*_{eao}(R_{eao}ED^*JX + X_{res}))$$
$$= MR^*_{eao}(R_{eao}ED^*JX + X_{res}) + a(X - DR^*_{eao}(R_{eao}ED^*JX + X_{res}))$$
$$= MR^*_{eao}X_{eao} + a(X - DR^*_{eao}X_{eao})$$

Now, a detailed mathematical description of the simplified method "A" is provided:

$$\begin{aligned}
\hat{X} &= M_D(GX + X_{dif}) \\
&= M_D(GX + R^*_{eao}X_{res} + R^*_{nonEao}X_{nonRes}) \\
&= M_D(GX + R^*_{eao}X_{res} - R^*_{nonEao}(D^*_{nonEao}D_{nonEao})^{-1}DR^*_{nonEao}D_{eao}X_{res}) \\
&= M_D(GX + R^*_{eao}X_{res} - R^*_{nonEao}D^*_{nonEao}(D_{nonEao}D^*_{nonEao})^{-1}D_{eao}X_{res}) \\
&= M_D\begin{pmatrix} R^*_{eao}R_{eao}GX + R^*_{eao}X_{res} + R^*_{nonEao}R_{nonEao}GX - \\ R^*_{nonEao}D^*_{nonEao}(D_{nonEao}D^*_{nonEao})^{-1}D_{eao}X_{res} \end{pmatrix} \\
&= M_D\left(R^*_{eao}X_{res} + R^*_{nonEao}\begin{pmatrix} R_{nonEao}GX - \\ D^*_{nonEao}(D_{nonEao}D^*_{nonEao})^{-1}D_{eao}X_{res} \end{pmatrix}\right) \\
&= MR^*_{eao}X_{eao} + aDR^*_{nonEao}R_{nonEao}R^*_{nonEao} \\
&\quad (R_{nonEao}GX - D^*_{nonEao}(D_{nonEao}D^*_{nonEao})^{-1}D_{eao}X_{res}) \\
&= MR^*_{eao}X_{eao} + aDR^*_{nonEao}R_{nonEao}GX - \\
&\quad aD_{nonEao}D^*_{nonEao}(D_{nonEao}D^*_{nonEao})^{-1}D_{eao}X_{res} \\
&= MR^*_{eao}X_{eao} + aDR^*_{nonEao}R_{nonEao}GX - aD_{eao}X_{res} \\
&= MR^*_{eao}X_{eao} + (X - DR^*_{eao}R_{eao}GX) - aD_{eao}X_{res} \\
&= MR^*_{eao}X_{eao} + a(X - DR^*_{eao}X_{eao})
\end{aligned}$$

It can be seen that the two results are identical when the assumption of the rendering matrix holds.

Now a special case of rendering matrix 2 is considered:

Including an additional constraint on the structure of the rendering matrix $M_S$ of the size $N_{DmxCh} \times N_{Objects}$: all the non-EAOs are modified only by a common scaling factor a compared to the downmix, and also all the EAOs are modified only by a common scaling factor b compared to the downmix.

$$M_D = bDR_{eao}{}^*R_{eao} + aDR_{nonEao}{}^*R_{nonEao} = D(bR_{eao}{}^*R_{eao} + aR_{nonEao}{}^*R_{nonEao}).$$

Continuing from the earlier results, the output of the system will be $$\begin{aligned}
\hat{X} &= bDR^*_{eao}X_{eao} + a(X - DR^*_{eao}X_{eao}) \\
&= aX + (b - a)DR^*_{eao}X_{eao} \\
&= aX + (b - a)DR^*_{eao}(R_{eao}ED^*JX + X_{res})
\end{aligned}$$

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[BCC] C. Faller and F. Baumgarte, "Binaural Cue Coding-Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008

[SAOC] ISO/IEC, "MPEG audio technologies—Part 2: Spatial Audio Object Coding (SAOC)," ISO/IEC JTC1/SC29/WG11 (MPEG) International Standard 23003-2:2010.

[ISS1] M. Parvaix and L. Girin: "Informed Source Separation of underdetermined instantaneous Stereo Mixtures using Source Index Embedding", IEEE ICASSP, 2010

[ISS2] M. Parvaix, L. Girin, J.-M. Brossier: "A watermarking-based method for informed source separation of audio signals with a single sensor", IEEE Transactions on Audio, Speech and Language Processing, 2010

[ISS3] A. Liutkus and J. Pinel and R. Badeau and L. Girin and G. Richard: "Informed source separation through spectrogram coding and data embedding", Signal Processing Journal, 2011

[ISS4] A. Ozerov, A. Liutkus, R. Badeau, G. Richard: "Informed source separation: source coding meets source separation", IEEE Workshop on Applications of Signal Processing to Audio and Acoustics, 2011

[ISS5] Shuhua Zhang and Laurent Girin: "An Informed Source Separation System for Speech Signals", INTERSPEECH, 2011

[ISS6] L. Girin and J. Pinel: "Informed Audio Source Separation from Compressed Linear Stereo Mixtures", AES 42nd International Conference: Semantic Audio, 2011

[Dfx] C. Falch and L. Terentiev and J. Herre: "Spatial Audio Object Coding with Enhanced Audio Object Separation", $10^{th}$ International Conference on Digital Audio Effects, 2010

The invention claimed is:

1. An audio decoding apparatus for generating a plurality of second estimated audio object signals from at least three audio downmix signals, comprising:

a parametric decoding unit configured to generate a plurality of first estimated audio object signals by upmixing the at least three audio downmix signals, wherein the at least three audio downmix signals encode a plurality of original audio object signals, wherein the parametric decoding unit is configured to upmix the at least three audio downmix signals depending on parametric side information indicating information on the plurality of original audio object signals, and a residual processing unit configured to modify one or more of the first estimated audio object signals to obtain the plurality of second estimated audio object signals, wherein the residual processing unit is configured to modify said one or more of the first estimated audio object signals depending on one or more residual audio signals, wherein at least one of the parametric decoding unit and the residual processing unit is implemented using a hardware apparatus or a computer or a combination of a hardware apparatus and a computer.

2. An audio decoding apparatus according to claim 1, wherein the residual processing unit is configured to modify said one or more of the first estimated audio object signals depending on at least three residual audio signals, and wherein the audio decoding apparatus is adapted to generate at least three audio output channels based on the plurality of second estimated audio object signals.

3. An audio decoding apparatus according to claim 1, wherein the audio decoding apparatus further comprises a downmix modification unit being adapted to remove one or more audio object signals of the plurality of second estimated audio object signals determined by the residual processing unit from the at least three audio downmix signals to acquire three or more modified audio downmix signals, and wherein the parametric decoding unit is configured to determine one or more audio object signals of the first estimated audio object signals based on the three or more modified audio downmix signals.

4. An audio decoding apparatus according to claim 3, wherein the downmix modification unit is adapted to apply the formula:

$$\tilde{X}_{nonEAO}=X-DZ_{eao}*S_{eao}.$$

to remove the one or more audio object signals of the plurality of second estimated audio object signals determined by the residual processing unit from the at least three audio downmix signals to acquire three or more modified audio downmix signals, wherein X indicates at least the three audio downmix signals before being modified $\tilde{X}_{nonEAO}$ indicates the three or more modified audio downmix signals D indicates downmixing information $S_{eao}$ comprises said one or more audio object signals of the plurality of second estimated audio object signals, and $Z_{eao}*$ indicates the locations of said one or more audio object signals of the plurality of second estimated audio object signals.

5. An audio decoding apparatus according to claim 3, wherein, the audio decoding apparatus is adapted to conduct two or more iteration steps, wherein, for each iteration step, the parametric decoding unit is adapted to determine exactly one audio object signal of the plurality of first estimated audio object signals, wherein for said iteration step, the residual processing unit is adapted to determine exactly one audio object signal of the plurality of second estimated audio object signals by modifying said audio object signal of the plurality of first estimated audio object signals, wherein, for said iteration step, the downmix modification unit is adapted to remove said audio object signal of the plurality of second estimated audio object signals from the at least three audio downmix signals to modify the at least three audio downmix signals, and wherein, for the next iteration step following said iteration step, the parametric decoding unit is adapted to determine exactly one audio object signal of the plurality of first estimated audio object signals based on the at least three audio downmix signals which have been modified.

6. An audio decoding apparatus according to claim 1, wherein each of the one or more residual audio signals indicates a difference between one of the plurality of original audio object signals and one of the one or more first estimated audio object signals.

7. An audio decoding apparatus according to claim 1, wherein the residual processing unit is adapted to generate the plurality of second estimated audio object signals by modifying five or more of the first estimated audio object signals, wherein the residual processing unit is configured to modify said five or more of the first estimated audio object signals depending on five or more residual audio signals.

8. An audio decoding apparatus according to claim 1, wherein the audio decoding apparatus is configured to generate seven or more audio output channels based on the plurality of second estimated audio object signals.

9. An audio decoding apparatus according to claim 1, wherein the audio decoding apparatus is adapted to not determine Channel Prediction Coefficients to determine the plurality of second estimated audio object signals.

10. An audio decoding apparatus according to claim 1, wherein the audio decoding apparatus is an SAOC decoder.

11. A residual signal apparatus for audio encoding by generating a plurality of residual audio signals, comprising:

a parametric decoding unit for generating a plurality of estimated audio object signals by upmixing at least three audio downmix signals, wherein the at least three audio downmix signals encode a plurality of original audio object signals, wherein the parametric decoding unit is configured to upmix the at least three audio downmix signals depending on parametric side information indicating information on the plurality of original audio object signals, and a residual estimation unit for generating the plurality of residual audio signals based on the plurality of original audio object signals and based on the plurality of estimated audio object signals, such that each of the plurality of residual audio signals is a difference signal indicating a difference between one of the plurality of original audio object signals and one of the plurality of estimated audio object signals, wherein at least one of the parametric decoding unit and the residual estimation unit is implemented using a hardware apparatus or a computer or a combination of a hardware apparatus and a computer.

12. A residual signal apparatus according to claim 11, wherein the residual signal generator further comprises a downmix modification unit being adapted to modify the at least three audio downmix signals to acquire three or more modified audio downmix signals, and wherein the parametric decoding unit is configured to determine one or more audio object signals of the first estimated audio object signals based on the three or more modified downmix signals.

13. A residual signal apparatus according to claim 12, wherein the downmix modification unit is configured to modify the three or more original audio downmix signals to acquire the three or more modified audio downmix signals, by removing one or more of the plurality of original audio object signals from the three or more original audio downmix signals.

14. A residual signal apparatus according to claim 13, wherein the downmix modification unit is adapted to apply the formula:

$$\tilde{X}_{nonEAO}=X-DZ_{eao}*S_{eao}.$$

to remove the one or more of the plurality of original audio object signals from the at least three audio downmix signals to acquire three or more modified audio downmix signals, wherein X indicates the at least three audio downmix signals before being modified $\tilde{X}_{nonEAO}$ indicates the three or more modified audio downmix signals D indicates downmixing information $S_{eao}$ comprises said one or more of the plurality of original audio object signals, and $Z_{eao}*$ indicates the locations of said one or more of the plurality of original audio object signals.

15. A residual signal apparatus according to claim 12, wherein the downmix modification unit is configured to modify the three or more original audio downmix signals to acquire the three or more modified audio downmix signals by generating one or more modified audio object signals based on one or more of the estimated audio object signals and based on one or more of the residual audio signals, and by removing the one or more modified audio object signals from the three or more original audio downmix signals.

16. A residual signal apparatus according to claim 15, wherein the downmix modification unit is adapted to apply the formula:

$$\tilde{X}_{nonEAO}=X-DZ_{eao}*S_{eao}.$$

to remove the one or more modified audio object signals from the at least three audio downmix signals to acquire three or more modified downmix signals, wherein X indicates the at least three audio downmix signals before being modified $\tilde{X}_{nonEAO}$ indicates the three or more modified audio downmix signals D indicates downmixing information $S_{eao}$ comprises said one or more modified audio object signals, and $Z_{eao}*$ indicates the locations of said one or more modified audio object signals.

17. A residual signal apparatus according to claim 12, wherein, the residual signal generator is adapted to conduct two or more iteration steps, wherein, for each iteration step, the parametric decoding unit is adapted to determine exactly one audio object signal of the plurality of estimated audio object signals, wherein for said iteration step, the residual estimation unit is adapted to determine exactly one residual audio signal of the plurality of residual audio signals by modifying said audio object signal of the plurality of estimated audio object signals, wherein, for said iteration step, the downmix modification unit is adapted to modify the at least three audio downmix signals, and wherein, for the next iteration step following said iteration step, the parametric decoding unit is adapted to determine exactly one audio object signal of the plurality of estimated audio object signals based on the at least three audio downmix signals which have been modified.

18. A residual signal apparatus according to claim 11, wherein the residual estimation unit is adapted to generate at least five residual audio signals based on at least five original audio object signals of the plurality of original audio object signals and based on at least five estimated audio object signals of the plurality of estimated audio object signals.

19. An audio encoding apparatus for encoding a plurality of original audio object signals by generating at least three audio downmix signals, by generating parametric side information and by generating a plurality of residual audio signals, wherein the audio encoding apparatus comprises:

a downmix generator for providing the at least three audio downmix signals indicating a downmix of the plurality of original audio object signals, a parametric side information estimator for generating the parametric side information indicating information on the plurality of original audio object signals, to acquire the parametric side information, and a residual signal apparatus for audio encoding by generating a plurality of residual audio signals, comprising:

a parametric decoding unit for generating a plurality of estimated audio object signals by upmixing at least three audio downmix signals, wherein the at least three audio downmix signals encode a plurality of original audio object signals, wherein the parametric decoding unit is configured to upmix the at least three audio downmix signals depending on parametric side information indicating information on the plurality of original audio object signals, and a residual estimation unit for generating the plurality of residual audio signals based on the plurality of original audio object signals and based on the plurality of estimated audio object signals, such that each of the plurality of residual audio signals is a difference signal indicating a difference between one of the plurality of original audio object signals and one of the plurality of estimated audio object signals, wherein at least one of the parametric decoding unit and the residual estimation unit is implemented using a hardware apparatus or a computer or a combination of a hardware apparatus and a computer wherein the parametric decoding unit of the residual signal generator is adapted to generate the plurality of estimated audio object signals by upmixing the at least three audio downmix signals provided by the downmix generator, wherein the audio downmix signals encode the plurality of original audio object signals, wherein the parametric decoding unit is configured to upmix the at least three audio downmix signals depending on the parametric side information generated by the parametric side information estimator, and wherein the residual estimation unit of the residual signal generator is adapted to generate the plurality of residual audio signals based on the plurality of original audio object signals and based on the plurality of estimated audio object signals, such that each of the plurality of residual audio signals indicates said difference between said one of the plurality of original audio object signals and said one of the plurality of estimated audio object signals.

20. An audio encoding apparatus according to claim 19, wherein the encoder is an SAOC encoder.

21. A system, comprising:

an audio encoding apparatus according to claim 19 for encoding a plurality of original audio object signals by generating at least three audio downmix signals, by generating parametric side information and by generating a plurality of residual audio signals, and an audio decoding apparatus audio decoding apparatus for generating a plurality of second estimated audio object signals from at least three audio downmix signals, comprising:

a parametric decoding unit configured to generate a plurality of first estimated audio object signals by upmixing the at least three audio downmix signals, wherein the at least three audio downmix signals encode a plurality of original audio object signals, wherein the parametric decoding unit is configured to upmix the at least three audio downmix signals depending on parametric side information indicating information on the plurality of original audio object signals, and a residual processing unit configured to modify one or more of the first estimated audio object signals to obtain the plurality of second estimated audio object signals, wherein the residual processing unit is configured to modify said one or more of the first estimated audio object signals depending on one or more residual audio signals, wherein at least one of the parametric decoding unit and the residual processing unit is implemented using a hardware apparatus or a computer or a combination of a hardware apparatus and a computer wherein the audio decoding apparatus is configured to generate the plurality of second estimated audio object signals based on the at least three audio downmix signals being generated by the audio encoding apparatus, based on the parametric side information being generated by the audio encoding apparatus and based on the plurality of residual audio signals being generated by the audio encoding apparatus.

22. A method for audio decoding by generating a plurality of second estimated audio object signals from at least three audio downmix signals, comprising:

generating a plurality of first estimated audio object signals by upmixing the at least three audio downmix signals, wherein the at least three audio downmix signals encode a plurality of original audio object signals, wherein generating the plurality of first estimated audio object signals comprises upmixing the at least three audio downmix signals depending on parametric side information indicating information on the plurality of original audio object signals, and modifying one or more of the first estimated audio object signals to obtain the plurality of second estimated audio object signals, wherein generating a plurality of second estimated audio object signals comprises modifying said one or more of the first estimated audio object signals depending on one or more residual audio signals, wherein the method is performed using a hardware apparatus or a computer or a combination of a hardware apparatus and a computer.

23. A method for audio encoding by generating a plurality of residual audio signals, comprising:

generating a plurality of estimated audio object signals by upmixing at least three audio downmix signals, wherein the at least three audio downmix signals encode a plurality of original audio object signals, wherein generating the plurality of estimated audio object signals comprises upmixing the at least three audio downmix signals depending on parametric side information indicating information on the plurality of original audio object signals, and generating the plurality of residual audio signals based on the plurality of original audio object signals and based on the plurality of estimated audio object signals, such that each of the plurality of residual audio signals is a difference signal indicating a difference between one of the plurality of original audio object signals and one of the plurality of estimated audio object signals, wherein the method is performed using a hardware apparatus or a computer or a combination of a hardware apparatus and a computer.

24. A non-transitory computer-readable medium comprising a computer program for implementing a method for audio decoding by generating a plurality of second estimated audio object signals from at least three audio downmix signals, when being executed on a computer or signal processor, wherein the method comprises:

generating a plurality of first estimated audio object signals by upmixing the at least three audio downmix signals, wherein the at least three audio downmix signals encode a plurality of original audio object signals, wherein generating the plurality of first estimated audio object signals comprises upmixing the at least three audio downmix signals depending on parametric side information indicating information on the plurality of original audio object signals, and modifying one or more of the first estimated audio object signals to obtain the plurality of second estimated audio object signals, wherein generating a plurality of second estimated audio object signals comprises modifying said one or more of the first estimated audio object signals depending on one or more residual audio signals.

25. A non-transitory computer-readable medium comprising a computer program for implementing a method for audio encoding by generating a plurality of residual audio signals, when being executed on a computer or signal processor, wherein the method comprises:

generating a plurality of estimated audio object signals by upmixing at least three audio downmix signals, wherein the at least three audio downmix signals encode a plurality of original audio object signals, wherein generating the plurality of estimated audio object signals comprises upmixing the at least three audio downmix signals depending on parametric side information indicating information on the plurality of original audio object signals, and generating the plurality of residual audio signals based on the plurality of original audio object signals and based on the plurality of estimated audio object signals, such that each of the plurality of residual audio signals is a difference signal indicating a difference between one of the plurality of original audio object signals and one of the plurality of estimated audio object signals.

* * * * *